US008496453B2

(12) United States Patent
Kang et al.

(10) Patent No.: US 8,496,453 B2
(45) Date of Patent: Jul. 30, 2013

(54) LINEAR COMPRESSOR

(75) Inventors: Yang-Jun Kang, Changwon-shi (KR); Young-Hoan Jeon, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 491 days.

(21) Appl. No.: 12/739,476

(22) PCT Filed: Oct. 10, 2008

(86) PCT No.: PCT/KR2008/005997
§ 371 (c)(1),
(2), (4) Date: Apr. 23, 2010

(87) PCT Pub. No.: WO2009/054637
PCT Pub. Date: Apr. 30, 2009

(65) Prior Publication Data

US 2011/0194957 A1 Aug. 11, 2011

(30) Foreign Application Priority Data

Oct. 24, 2007 (KR) ..... 10-2007-0107362

(51) Int. Cl.
*F04B 35/04* (2006.01)
*F04B 17/04* (2006.01)

(52) U.S. Cl.
USPC ..... 417/417; 417/44.1; 310/15; 310/17

(58) Field of Classification Search
USPC ..... 417/44.1, 417, 312; 310/17, 15, 310/19
See application file for complete search history.

(56) References Cited

U.S. PATENT DOCUMENTS

| | | | | |
|---|---|---|---|---|
| 3,325,085 | A | 6/1967 | Gaus | |
| 3,659,968 | A * | 5/1972 | Thomas et al. | 417/417 |
| 6,413,057 | B1 | 7/2002 | Hong et al. | |
| 6,540,485 | B2 * | 4/2003 | Nara et al. | 417/44.1 |
| 6,676,388 | B2 * | 1/2004 | Lee et al. | 417/417 |

(Continued)

FOREIGN PATENT DOCUMENTS

| | | |
|---|---|---|
| DE | 1503416 | 1/1970 |
| DE | 102005005698 | 5/2006 |

(Continued)

OTHER PUBLICATIONS

International Search Report issued in PCT/KR2008/005997 dated Feb. 6, 2009.

(Continued)

*Primary Examiner* — Devon Kramer
*Assistant Examiner* — Joseph Herrmann
(74) *Attorney, Agent, or Firm* — KED & Associates LLP

(57) ABSTRACT

A linear compressor is provided, which has a reduced number of front main springs among springs continuously transmitting a force so that a piston can move in a resonance condition. The linear compressor includes a hermetic container to be filled with a refrigerant; a linear motor including an inner stator, an outer stator, and a permanent magnet; a piston linearly reciprocated by the linear motor; a cylinder that provides a space to compress the refrigerant; a supporter piston having a connecting portion connected to one end of the piston, a support portion that extends from the connecting portion, and an additional mass member fixing portion that extends from the connecting portion; front main springs, one end of each of which is supported by one surface of the supporter piston; and one rear main spring, one end of which is supported by the other surface of the supporter piston.

39 Claims, 17 Drawing Sheets

U.S. PATENT DOCUMENTS

| | | | | |
|---|---|---|---|---|
| 6,733,245 | B2 * | 5/2004 | Oh et al. | 417/211 |
| 6,793,470 | B2 * | 9/2004 | Song et al. | 417/417 |
| 6,851,934 | B2 * | 2/2005 | Yoo et al. | 417/44.11 |
| 6,873,067 | B2 * | 3/2005 | Ichii et al. | 310/15 |
| 6,881,042 | B2 * | 4/2005 | Heo et al. | 417/417 |
| 2003/0095879 | A1 | 5/2003 | Oh et al. | |
| 2005/0141998 | A1 * | 6/2005 | Yoo et al. | 417/44.1 |
| 2005/0271526 | A1 * | 12/2005 | Chang et al. | 417/417 |
| 2006/0078443 | A1 * | 4/2006 | Noh et al. | 417/417 |
| 2008/0223059 | A1 * | 9/2008 | Escanes Garcia | 62/230 |

FOREIGN PATENT DOCUMENTS

| | | |
|---|---|---|
| WO | WO 03/054390 | 7/2003 |
| WO | WO 2004/081421 | 9/2004 |
| WO | WO 2004081421 A2 * | 9/2004 |

OTHER PUBLICATIONS

European Search Report dated Nov. 3, 2010. (Application No. EP 08 84 1240).

* cited by examiner

Conventional Art

Comparative Example

Comparative Example

Comparative Example

Comparative Example

LINEAR COMPRESSOR

TECHNICAL FIELD

The present invention relates to a linear compressor, and more particularly, to a linear compressor, which makes it easier to manage operating conditions by reducing the number of springs continuously applying a force to a piston so that the piston can perform a resonance operation.

BACKGROUND ART

In general, a compressor is a mechanical apparatus for compressing the air, refrigerant or other various operation gases and raising a pressure thereof, by receiving power from a power generation apparatus such as an electric motor or turbine. The compressor has been widely used for an electric home appliance such as a refrigerator and an air conditioner, or in the whole industry.

The compressors are roughly classified into a reciprocating compressor in which a compression space for sucking or discharging an operation gas is formed between a piston and a cylinder, and the piston is linearly reciprocated inside the cylinder, for compressing a refrigerant, a rotary compressor in which a compression space for sucking or discharging an operation gas is formed between an eccentrically-rotated roller and a cylinder, and the roller is eccentrically rotated along the inner wall of the cylinder, for compressing a refrigerant, and a scroll compressor in which a compression space for sucking or discharging an operation gas is formed between an orbiting scroll and a fixed scroll, and the orbiting scroll is rotated along the fixed scroll, for compressing a refrigerant.

Recently, a linear compressor which can improve compression efficiency and simplify the whole structure without a mechanical loss resulting from motion conversion by connecting a piston directly to a linearly-reciprocated driving motor has been popularly developed among the reciprocating compressors.

FIG. 1 is a view illustrating a conventional linear compressor. FIG. 2 is a view illustrating the linear compressor of FIG. 1 as viewed from the back cover. In the linear compressor 1, the piston 30 is linearly reciprocated in a cylinder 20 by a linear motor 40 inside a hermetic shell 10, for sucking, compressing and discharging a refrigerant. The linear motor 40 includes an inner stator 42, an outer stator 44, and a permanent magnet 46 disposed between the inner stator 42 and the outer stator 44, and linearly reciprocated by a mutual electromagnetic force. As the permanent magnet 46 is driven in a state where it is coupled to the piston 30, the piston 30 is reciprocated linearly inside the cylinder 20 to suck, compress and discharge the refrigerant.

The linear compressor 1 further includes a frame 52, a stator cover 54, and a back cover 56. The linear compressor may have a configuration in which the cylinder 20 is fixed by the frame 52, or a configuration in which the cylinder 20 and the frame 52 are integrally formed. At the front of the cylinder 20, a discharge valve 62 is elastically supported by an elastic member, and selectively opened and closed according to the pressure of the refrigerant inside the cylinder. A discharge cap 64 and a discharge muffler 66 are installed at the front of the discharge valve 62, and the discharge cap 64 and the discharge muffler 66 are fixed to the frame 52. One end of the inner stator 42 or outer stator 44 as well is supported by the frame 52, and an 0-ring or the like of the inner stator 42 is supported by a separate member or a projection formed on the cylinder 20, and the other end of the outer stator 44 is supported by the stator cover 54. The back cover 56 is installed on the stator cover 54, and a muffler 70 is positioned between the back cover 56 and the stator cover 54.

Further, a supporter piston 32 is coupled to the rear of the piston 30. Main springs 80 whose natural frequency is adjusted are installed at the supporter piston 32 so that the piston 30 can be resonantly moved. The main springs 80 are divided into front springs 82 whose both ends are supported by the supporter piston 32 and the stator cover 54 and rear springs 84 whose both ends are supported by the supporter piston 32 and the back cover 56. The conventional linear compressor includes four front springs 82 and four rear springs 84 at longitudinally and laterally symmetrical positions. Accordingly, the number of main springs 82 to be provided and the positional parameters to be controlled in order to maintain balance upon movement of the piston 30 are eight, respectively. Consequently, the manufacturing process becomes complicated and longer and the manufacturing cost is high due to a large quantity of main springs and a large number of parameters to be controlled.

DISCLOSURE OF INVENTION

Technical Problem

It is an object of the present invention to provide a linear compressor, which has a reduced number of front main springs located at the front among main springs continuously transmitting a force so that a piston can move in a resonance condition.

It is another object of the present invention to provide a linear compressor, in which the stiffness of rear main springs is adjusted in accordance with the reduction of the number of front main springs.

It is still another object of the present invention to provide a linear compressor, which has a supporter piston whose mass is reduced in accordance with the reduction of the stiffness of the main springs.

It is yet still another object of the present invention to provide a linear compressor, which has a supporter piston that is surface-treated in the region contacting with the main springs.

It is yet still another object of the present invention to provide a linear compressor, which can vary an output of the linear compressor while symmetrically moving the piston between a top dead center and a bottom dead center by adjusting the shifting amount of the piston by a refrigerant gas by adjusting the elastic coefficient of the main springs.

It is yet still another object of the present invention to provide a linear compressor, which can change the reference flow rate of the linear compressor by the attachment of an additional mass member without changing the lengths of the piston and the cylinder and the initial position of the piston relative to the cylinder.

It is yet still another object of the present invention to provide a linear compressor, which can obtain an operation frequency corresponding to a reference flow rate and adjust a mechanical resonance frequency by the attachment of an additional mass member so that the mechanical resonance frequency corresponds to the operation frequency.

It is yet still another object of the present invention to provide a linear compressor, which has a reduced number of switches for controlling power supply to a linear motor.

It is yet still another object of the present invention to provide a linear compressor, which can compensate for mutual inductance generated when power is supplied to or cut off from the linear motor.

Technical Solution

The present invention provides a linear compressor, comprising: a hermetic container to be filled with a refrigerant; a linear motor including an inner stator, an outer stator, and a permanent magnet; a piston linearly reciprocating by the linear motor; a cylinder for providing a space for compressing the refrigerant upon linear reciprocation of the piston; a supporter piston having a connecting portion connected to one end of the piston and contacting with the piston, a support portion extended from the connecting portion and an additional mass member fixing portion extended from the connecting portion; a plurality of front main springs mounted at positions symmetrical with respect to the center of the piston and the supporter piston, one ends of which being supported by one surface of the supporter piston; and one rear main spring, one end of which being supported by the other surface of the supporter piston.

Additionally, the piston includes an extended portion to which the supporter piston is fastened, and the supporter piston further includes a fastening hole formed at the connecting portion, and for fastening to the extended portion.

Additionally, the supporter piston further includes a windage loss reduction hole formed at the connecting portion and formed at a position not overlapping with the fastening hole.

Additionally, the linear compressor further comprises a spring guider coupled to the other surface of the supporter piston, and for reinforcing a strength supporting the rear main spring.

Additionally, the spring guider has a center aligned with the center of the piston and the supporter piston, and is fixed to the supporter piston.

Additionally, the spring guider has a stepped portion for restraining one end of the rear main spring from moving in the radius direction of the spring guider.

Additionally, the supporter piston and the spring guider each has a guide hole for guiding a coupling position at positions corresponding to each other.

Additionally, of the spring guider, at least the portion contacting with the rear main spring has a larger hardness than the hardness of the rear main spring.

Additionally, the linear compressor further comprises a suction muffler for reducing noise while introducing a refrigerant into the piston, part of which being inserted into the piston by passing through a refrigerant inlet hole of the supporter piston.

Additionally, the suction muffler includes a main body having an generally circular shape, one end of which being extended in a radius direction so as to be connected to the supporter piston and the other end of which having a refrigerant inlet hole for introducing a refrigerant, an internal noise tube positioned inside the main body, and an external noise tube positioned within the piston.

Additionally, the supporter piston is provided with a seat portion for guiding the main body of the suction muffler so as to be aligned with respect to the supporter piston.

Additionally, the suction muffler is made of an injection-moldable material.

Additionally, the internal noise tube and the external noise tube are integrally formed.

Additionally, the suction muffler is fastened to the supporter piston by a fastening member, and the spring guider is provided with a fastening member receiving hole for receiving the fastening member fastening the supporter piston and the suction muffler.

Additionally, the linear compressor further comprises a back cover for supporting the other end of the rear main spring, and including at least either a bent portion or projected portion for fixing the other end of the rear main spring.

Additionally, the linear compressor further comprises a back muffler positioned between the back cover and the hermetic container.

Additionally, the back muffler is welded to the back cover.

Additionally, the back muffler is formed in an generally circular shape and provided with a refrigerant inlet hole generally at the center part, with the back cover side face being opened and the center part of the hermetic container side face being projected toward the hermetic container.

Additionally, the front main springs and the rear main spring have a natural frequency generally coinciding with the resonant operation frequency of the piston.

Additionally, the linear compressor further comprises a stator cover for supporting one end of the outer stator and the other end of the front main springs.

Additionally, the stator cover has a front main spring support portion having the number and position corresponding to the number and position of the front main springs.

Additionally, the front main springs and the rear main spring have generally the same stiffness.

Additionally, the front main springs and the rear main spring have generally the same length in a state that the linear compressor is not driven.

Additionally, the linear compressor further comprises an additional mass member to be selectively mounted to the supporter piston.

Additionally, the additional mass member is provided in plurality are attachable to and detachable from the supporter piston.

Additionally, the mass of the additional mass member is a mass with which the piston can be operated in a resonance condition in consideration of a stroke of the piston determined depending on a refrigerant compression capacity of the linear compressor.

Additionally, the linear compressor further comprises a control unit for controlling an operation frequency of the supporter piston in accordance with the mounting or not of the additional mass member and the mass thereof.

Additionally, the control unit controls operation frequency by tracking a mechanical resonance frequency depending on the mass of the additional mass member in a lower power condition.

Additionally, the control unit controls operation frequency so that the phase difference between position of the piston and a current can be the smallest value.

Additionally, the shifting amount of the piston determined by the spring constant of the front main springs and rear main spring allows the piston to symmetrically move between a top dead center and a bottom dead center in the maximum load operation condition of the linear compressor.

Additionally, an initial position of the piston with respect to the cylinder is determined so that the piston symmetrically moves between a top dead center and a bottom dead center in the maximum load operation condition.

Additionally, the linear compressor further comprises a control unit for controlling the piston to reciprocate in a resonance condition.

Additionally, the control unit adjusts the operation frequency of the piston according to a required cooling capacity.

Additionally, the control unit controls the motion of the piston so that differences in current phase and in piston position may be the smallest.

Additionally, the control unit calculates the position of the top dead center of the piston according to a required cooling capacity of the linear compressor by using the inflection point of phase and stroke.

Additionally, the control unit includes a PWM full-bridge inverter control logic for controlling the calculated top dead center position of the piston and the actual top dead center position of the piston to coincide with each other.

Additionally, the control unit includes a rectifier circuit and two inverter switches.

Additionally, the rectifier circuit includes a back pressure rectification circuit.

Additionally, the linear compressor further comprises a power supply apparatus including a rectifier unit for rectifying AC power to direct current and an inverter switch unit for controlling the application of a rectified voltage to the linear motor, for supplying power to the linear motor.

Advantageous Effects

The linear compressor provided in the present invention can reduce parts production costs because the number of the entire main springs is reduced.

Additionally, the linear compressor provided in the present invention can reduce the manufacturing cost of the main springs because the stiffness of the main springs is reduced.

Additionally, the linear compressor provided in the present invention can maintain a resonance condition even if the stiffness of the main springs is reduced because the supporter piston is made of metal having a low density and thus the mass of the entire driving unit is reduced.

Additionally, the linear compressor provided in the present invention can prevent the supporter piston from being abraded by the movement of the front main springs because a region where the supporter piston and the front main springs are contact with each other is surface-treated.

Additionally, the linear compressor provided in the present invention enables the supporter piston to be easily coupled to the piston because the supporter piston is made of a non iron-based metal and thus has no effect from the permanent magnet.

Additionally, the linear compressor provided in the present invention can reduce production costs and make control easier because the number of switches at the control unit of the linear motor can be reduced.

Additionally, the linear compressor provided in the present invention can easily change the reference flow rate of the linear compressor by adjusting a mechanical resonance frequency in accordance with the attachment or detachment of an additional mass member and the mass of the additional mass member.

Additionally, the linear compressor provided in the present invention can allow the frequency of a power applied to the linear motor to track a mechanical resonance frequency adjusted by the addition of an additional mass member.

Additionally, the linear compressor provided in the present invention can increase the stroke of the piston by the shifting amount of the piston by a refrigerant gas upon an increase of the compression capacity by decreasing the elastic coefficient of the main springs.

Additionally, the linear compressor provided in the present invention can input a voltage symmetrically into the linear motor even under an overload condition, that is, the condition that the compression capacity of the linear compressor is maximized.

MODE FOR THE INVENTION

Figure 3:
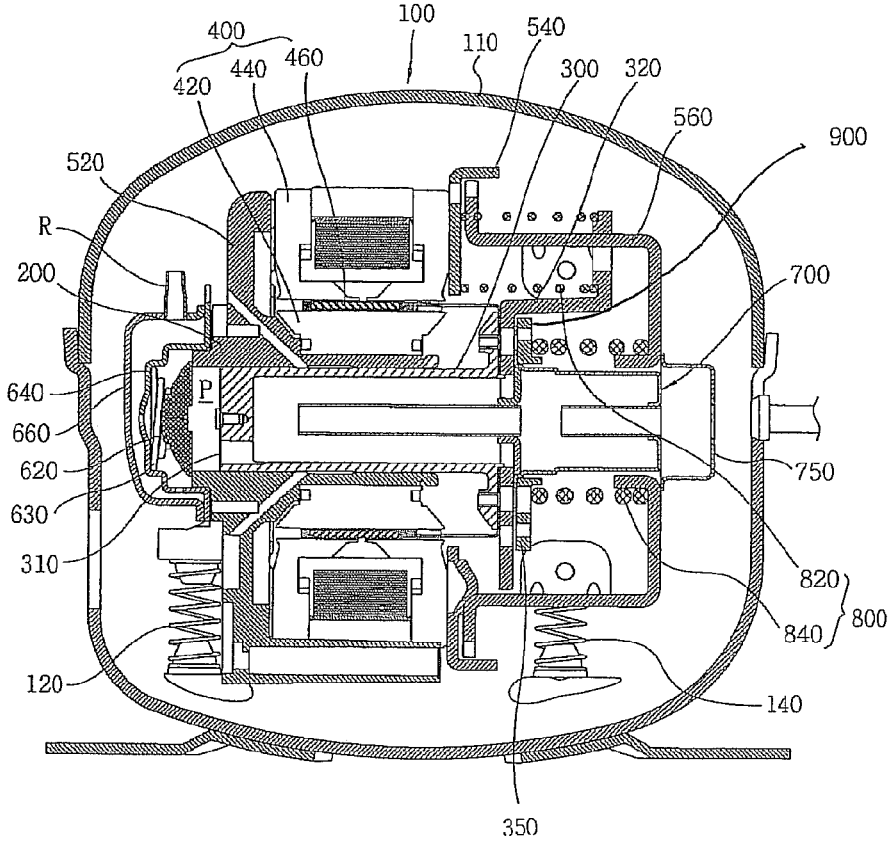
FIG. 3 is a view illustrating a cross section of a linear compressor according to one embodiment of the present invention.

Hereinafter, the present invention will be described in more detail with reference to the accompanying drawings. FIG. 3 is a view illustrating a cross section of a linear compressor according to one embodiment of the present invention. The linear compressor 100 has parts for compressing a refrigerant within a shell 110, which is a hermetic vessel, the inside of the shell 110 being filled with a low pressure refrigerant. The linear compressor 100 comprises a cylinder 200 providing a space for compressing a refrigerant inside the shell 100, a piston 300 linearly reciprocating inside the cylinder to compress the refrigerant, and a linear motor 400 including a permanent magnet 460, an inner stator 420 and an outer stator 440. When the permanent magnet is linearly reciprocated by a mutual electromagnetic force between the inner stator and the outer stator, the piston 300 connected to the permanent magnet 460 is linearly reciprocated along with the permanent magnet 460. The inner stator 420 is fixed to the outer periphery of the cylinder 200. Further, the outer stator 440 is fixed to a frame 520 by a stator cover 540. The frame 520 may be formed integral with the cylinder 200, or may be manufactured separately from the cylinder 200 to be coupled to the cylinder 200. In the embodiment as shown in FIG. 3, an example of integrally forming the frame 520 and the cylinder 200 is illustrated. The frame 520 and the stator cover 540 are coupled to each other, being fastened by a fastening member, such as a bolt, thereby fixing the outer stator 440 between the frame 520 and the stator cover 540.

A supporter piston 320 is connected to the rear of the piston 300. Both ends of front main springs 820 are supported by the supporter piston 320 and the stator cover 540. Further, both ends of a rear main spring 840 are supported by the supporter piston 320 and a back cover 560, and the back cover 560 is coupled to the rear of the stator cover 540. In order to prevent abrasion of the supporter piston 320 and increase the support strength of the rear main spring 840, the supporter piston 320 is provided with a spring guider 900. The spring guider 900 serves to guide the centers of the piston 300 and the rear main spring 840 so as to coincide with each other, as well as serving to support the rear main spring 840. At the rear of the piston 300, a suction muffler 700 is provided so as to reduce noise during the suction of refrigerant as the refrigerant is introduced into the piston through the suction muffler 700. The suction muffler 700 is positioned inside the rear main spring 840.

The inside of the piston 300 is hollowed out to introduce the refrigerant introduced through the suction muffler 700 into a compression space P formed between the cylinder 200 and the piston 300 and compress it. A valve 310 is installed at the front end of the piston 300. The valve 310 is opened to introduce the refrigerant into the compression space P from the piston 300, and closes the front end of the piston 300 so as to avoid the refrigerant from being introduced again into the piston from the compression space P.

If the refrigerant is compressed by the piston 300 in the compression space P at a pressure higher than a predetermined level, a discharge valve 620 positioned on the front end of the cylinder 200 is opened. The discharge valve 620 is installed so as to be elastically supported by a spiral discharge valve spring inside a support cap 640 fixed to one end of the cylinder 200. The compressed refrigerant of high pressure is discharged into a discharge cap 660 through a hole formed on the support cap 640, and then discharged out of the linear compressor 100 through a loop pipe R thus to circulate the refrigerating cycle.

Each of the parts of the above-described linear compressor 100 is supported in an assembled state by a front support spring 120 and a rear support spring 140, and is spaced apart from the bottom of the shell 110. Since the parts are not in direct contact with the bottom of the shell 110, vibrations generated from each of the parts are no directly transmitted to the shell 110. Therefore, noise generated from the vibration transmitted to the outside of the shell 110 and the vibration of the shell 110 can be reduced.

Figure 4:
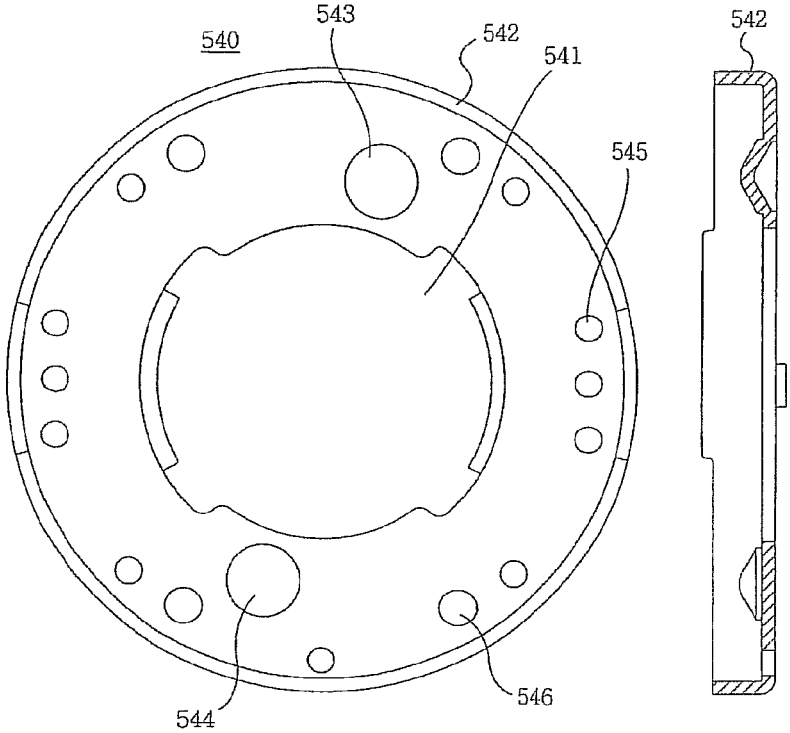
FIG. 4 is a view illustrating a stator cover of the linear compressor according to one embodiment of the present invention.

FIG. 4 is a view illustrating a stator cover of the linear compressor according to one embodiment of the present invention. The stator cover 540 is generally circular, and has a hole 541 formed therein so that an assembly in which the piston 300 (shown in FIG. 3), permanent magnet 460 (shown in FIG. 3), supporter piston 320 (shown in FIG. 3) and muffler 700 (shown in FIG. 3) are coupled can penetrate through the stator cover 540 and linearly reciprocate. Further, a bent portion 542 is formed along the outer periphery of the stator cover 540. The bent portion 542 increases the support strength of the stator cover 540.

The center of the stator cover 540 coincides with the center of the piston, and two front main spring support projections 543 and 544 are formed at positions symmetrical to these centers. The front main spring support projections 543 and 544 support both ends of the front main springs along with the supporter piston 320 (shown in FIG. 3). The front main spring support projections 543 and 544 support the front end (the other end) of the front main springs, and the supporter piston 320 (shown in FIG. 3) support the rear end (one end) of the front main spring.

Besides, a plurality of bolt holes 545 for fastening the back cover 560 (shown in FIG. 3) by bolts and a plurality of bolt holes 546 for fastening the frame 520 by bolts are formed at both sides of the stator cover 540.

Figure 5:
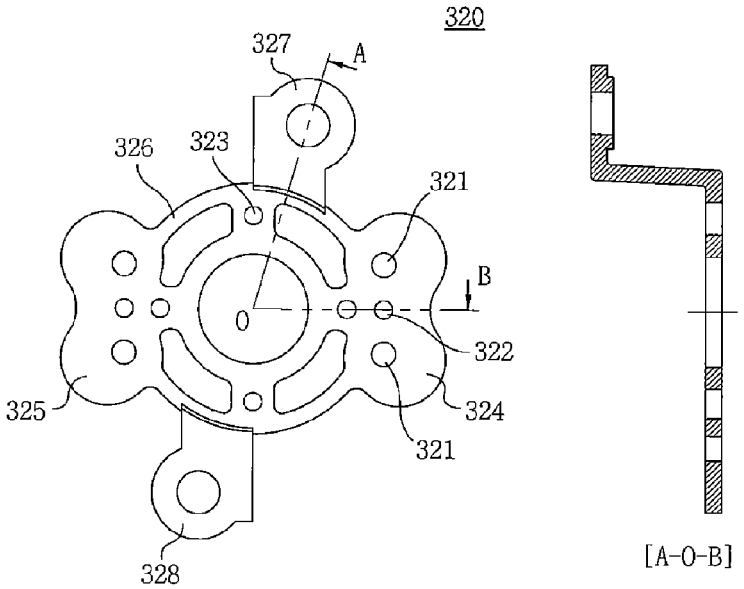
FIG. 5 is a view illustrating one example of a supporter piston provided in the linear compressor of the present invention.

FIG. 5 is a view illustrating one example of a supporter piston provided in the linear compressor of the present invention. The supporter piston 320 is coupled to the rear of the piston (shown in FIG. 3), and receives a force from the main springs 820 and 840 and transmits it to the piston 300 (shown in FIG. 3) so that the piston 300 (shown in FIG. 3) can linearly reciprocate under a resonance condition. The supporter piston 320 is provided with a plurality of bolt holes 323 to be coupled to the piston 300 (shown in FIG. 3).

The supporter piston 320 is installed such that its center is consistent with the center of the piston 300 (shown in FIG. 3). Preferably, a step is formed on the rear end of the piston 300 (shown in FIG. 3) so as to easily make the centers of the supporter piston 320 and the piston 300 (shown in FIG. 3) coincide with each other. The supporter piston 320 has such a shape in which support portions 327 and 328 and guide portions 324 and 325 are formed at the top, bottom, left, and right, respectively, of an generally circular body 326. The support portions 327 and 328 are formed at positions symmetrical with respect to the center of the supporter piston 320. The support portions 327 and 328 are formed at the top and bottom, respectively, of the body 326, and bent twice from the body 326. That is, the support portions 327 and 328 are bent once rearward from the body 326 and then bent upward or downward, respectively. The rear end (one end) of the front main springs 820 (shown in FIG. 3) is supported on the front of the support portions 327 and 328 of the supporter piston 320.

Figure 2:
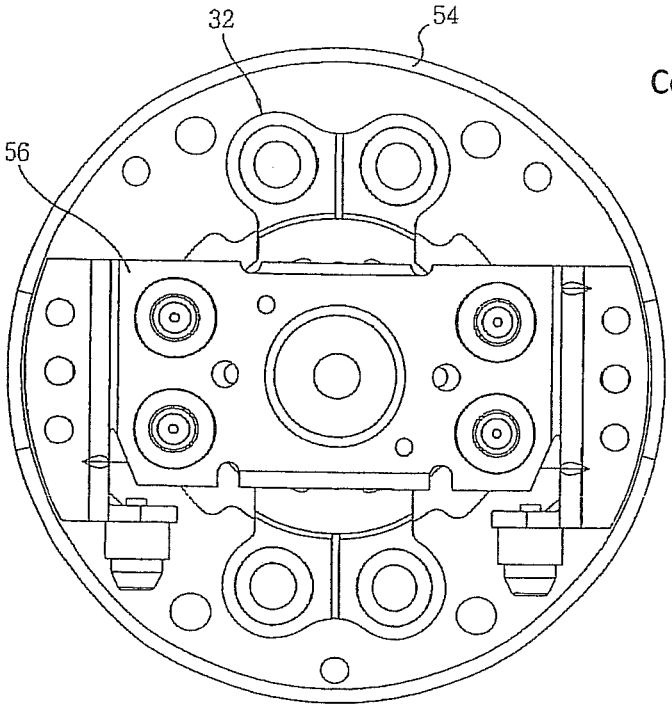
Conventional Art Fig. 2
FIG. 2 is a view illustrating the linear compressor of FIG. 1 as viewed from the back cover.

Further, the guide portions 324 and 325 are formed at the left and right of the body 326 of the supporter piston 320. Guide holes 321 for making the center of the spring guider 900 (shown in FIG. 3) consistent with the center of the piston 300 (shown in FIG. 2) and bolt holes 322 for fastening the spring guider 900 by bolts are formed at the guide portions 324 and 325. Besides, a muffler 700 (shown in FIG. 3) is fixed to the rear of the supporter piston 320.

Further, an additional mass member 350 (shown in FIG. 33) may be mounted to the guide portions 324 and 325. The additional mass member 350 can change the mechanical resonance frequency of the linear compressor by increasing the mass of a driving member including the piston 300 (shown in FIG. 3) without changing the lengths of the piston 300 (shown in FIG. 3) and the cylinder 200 (shown in FIG. 2). Therefore, since the cylinder 200 (shown in FIG. 3) and the piston 300 (shown in FIG. 3) having the same size are used, it is possible to manufacture a linear compressor having various reference flow rates by changing only the mass of the additional mass member 350 without changing the parts of the linear compressor.

The number of the front main springs 820 (shown in FIG. 3) is decreased to two and the number of the rear main spring 840 (shown in FIG. 3) is decreased to one, thereby decreasing the stiffness of the main springs on the whole. Further, if the stiffness of the front main springs 820 (shown in FIG. 3) and the rear main spring 840 (shown in FIG. 3) is decreased, respectively, the production cost of the main springs can be cut down.

At this time, if the stiffness of the front main springs 820 (shown in FIG. 3) and the rear main spring 840 (shown in FIG. 3) becomes smaller, the mass of the driving unit including the piston 300 (shown in FIG. 3), supporter piston 320 (shown in FIG. 3) and permanent magnet 460 (shown in FIG. 3) should be smaller to thus drive the driving unit under a resonance condition. Therefore, the supporter piston 320 is made of a non iron-based metal having a lower density than that of an iron-based metal, rather than being made of an iron-based metal. As a result, the mass of the driving unit can be reduced, and accordingly can be driven at a resonance frequency according to the decreased stiffness of the front main springs 820 (shown in FIG. 3) and the rear main spring 840 (shown in FIG. 3). For example, if the supporter piston 320 is made of a nonmagnetic metal, such as aluminum, even if the piston 300 (shown in FIG. 3) is made of a metal, the supporter piston 320 has no effect from the permanent magnet 300 (shown in FIG. 3). Therefore, the piston 300 (shown in FIG. 3) and the supporter piston 320 can be coupled to each other more easily.

If the supporter piston 320 is made of a non iron-based metal having a low density, this offers the advantage that the resonance condition is satisfied and the supporter piston 320 can be easily coupled to the piston 300 (shown in FIG. 3). However, the portion contacting with the front main springs 820 (shown in FIG. 3) may be easily abraded by a friction with the front main springs 820 (shown in FIG. 3) during driving. When the supporter piston 320 is abraded, abraded debris may damage the parts existing on the refrigerating cycle while floating in the refrigerant and circulating the refrigerating cycle. Therefore, surface treatment is performed on the portion where the supporter piston 320 and the front main springs 820 (shown in FIG. 3) are in contact with each other. By carrying out NIP coating or anodizing treatment, the surface hardness of the portion where the supporter piston 320 and the front main springs 820 (shown in FIG. 3) are in contact with each other is made larger at least than the hardness of the front main springs 820 (shown in FIG. 3). By this construction, it is possible to prevent the generation of debris by the supporter piston 320 being abraded by the front main springs 820 (shown in FIG. 3).

Figure 6:
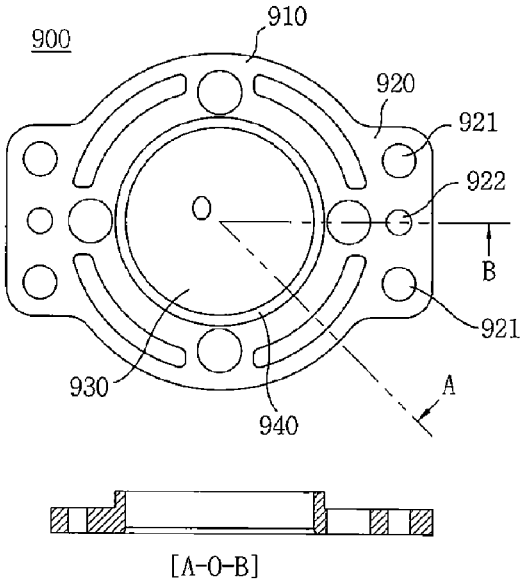
FIG. 6 is a view illustrating one example of a spring guider provided in the linear compressor of the present invention.

FIG. 6 is a view illustrating one example of a spring guider provided in the linear compressor of the present invention. The spring guider 900 comprises an generally circular body 910 and guide portions 920 at both sides of the body. The spring guider 900 supports the front end (one end) of the rear main spring 840 (shown in FIG. 3). A hole 930 through which the muffler 700 passes is formed at the center of the spring guider 900, and a support portion 940 projected rearward is formed along the outer periphery of the hole 930. The support portion 940 is a portion to which the rear main spring 840 (shown in FIG. 3) is fitted. Thus, the rear main spring 840 (shown in FIG. 3) comes in contact with the circumference of the hole 930 and the support portion 940 in the body 910. The region contacting with the rear main spring 840 (shown in FIG. 3) may be abraded by the rear main spring 840 (shown in FIG. 3) by repetitive compression and restoration of the rear main spring 840 (shown in FIG. 3). Abraded debris or the like of the spring guider 900 may damage the parts located on the refrigerating cycle while passing through the refrigerating cycle including the linear compressor 100 (shown in FIG. 3) along with a refrigerant. Therefore, surface treatment is performed on the portion where the spring guider 900 is in contact with the rear main spring 840 (shown in FIG. 3) to thus prevent abrasion of the rear main spring 840 (shown in FIG. 3). Preferably, the surface hardness of the spring guider 900 is larger than the hardness of the rear main spring 840 (shown in FIG. 3). Consequently, like the supporter piston 320 (shown in FIG. 5), the spring guider 900, too, undergoes surface treatment, such as NIP coating or anodizing.

Additionally, guide holes 921 and bolt holes 922 are formed at the guide portion 920 of the spring guider 900. The guide holes 921 are formed at positions corresponding to the guide holes 321 of the supporter piston 320 (shown in FIG. 5). by making guide holes 322 (shown in FIG. 5) of the supporter piston (shown in FIG. 5) consistent with the guide holes 921 of the spring guider 900, the center of the piston 300 (shown in FIG. 3) and the center of the main spring 840 (shown in FIG. 3) supported by the spring guider 900 can be made consistent with each other.

Figure 7:
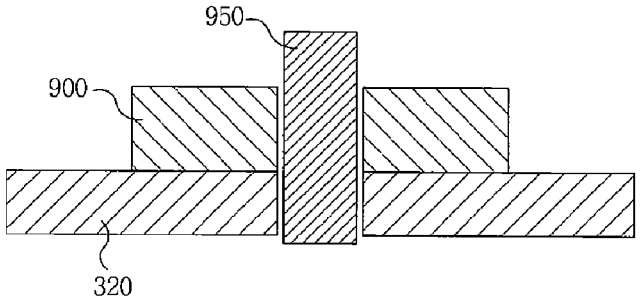
FIG. 7 is a view schematically illustrating a method for fastening the supporter piston and spring guider of the linear compressor according to one example of the present invention.

FIG. 7 is a view schematically illustrating a method for fastening the supporter piston and spring guider of the linear compressor according to one example of the present invention. The supporter piston 320 is fastened to the piston 300 (shown in FIG. 3) by a bolt. The supporter piston 320 and the piston 300 are coupled when fastened in such a manner that their centers are consistent with each other. Part of the rear of the muffler 700 (shown in FIG. 3) is coupled to the rear of the supporter piston 320, and then the supporter piston 320 and the spring guider 900 are coupled to each other. When coupling the spring guider 900, in order to make it easier to make the centers of the spring guider 900 and the supporter piston 320 consistent with each other, guide holes 321 (shown in FIGS. 5) and 921 (shown in FIG. 6) and bolt holes 322 (shown in FIGS. 5) and 922 (shown in FIG. 6) are formed at the supporter piston 320 and the spring guider 900, respectively.

As schematically shown in FIG. 7, guide pins 950 are inserted into the guide holes 321 (shown in FIG. 5) of the supporter piston 320 coupled to the piston 300 (shown in FIG. 3). Next, the guide pins 950 and the guide holes 921 of the spring guider 900 are made consistent with each other, to thus guide the spring guider 900 to an appropriate position. Next, bolts passing through bolt holes 322 (shown in FIGS. 5) and 922 (shown in FIG. 6) of the support piston 320 and spring guider 900 are fastened, thereby coupling the supporter piston 320 and the spring guider 900. As the installation piston of the spring guider 900 is guided by the guide pins 950, the centers of the supporter piston 320 and the spring guider 900 can be made consistent with each other more easily. Further, the piston 300 (shown in FIG. 3) and the supporter piston 320 are designed such that their centers are consistent with each other, and the spring guider 900 and the rear main spring 840 (shown in FIG. 3) are designed such that their centers are consistent with each other. Therefore, by making the centers of the supporter piston 320 and the spring guider 900 consistent with each other, the centers of the piston 300 (shown in FIG. 3) and the rear main spring 840 (shown in FIG. 3) can be made consistent with each other. The centers of the piston 300 (shown in FIG. 3) and the rear main spring 840 (shown in FIG. 3) should be consistent with each other to enable linear reciprocation of the piston 300 (shown in FIG. 3).

Figure 8:
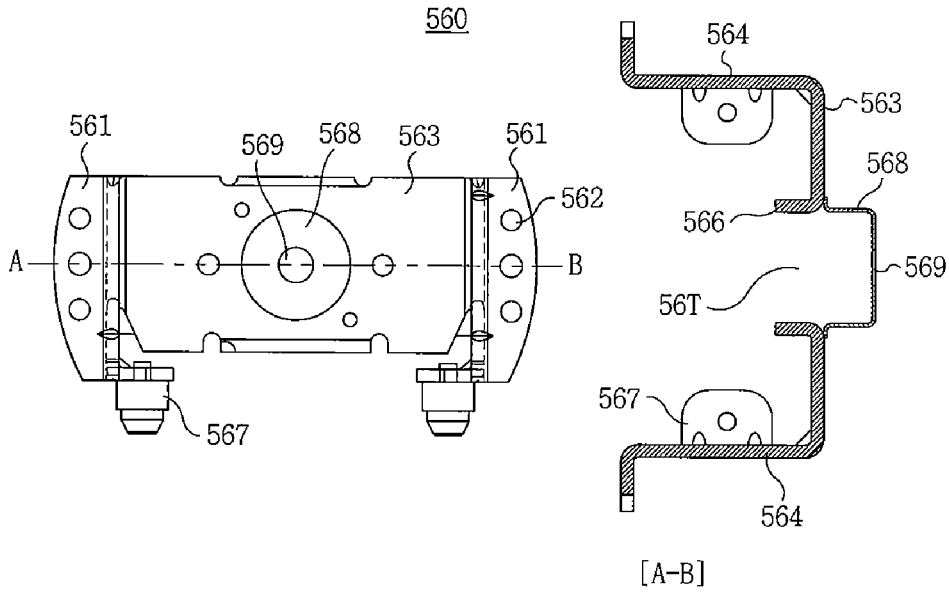
FIG. 8 is a view illustrating one example of a back cover provided in the linear compressor of the present invention.

FIG. 8 is a view illustrating one example of a back cover provided in the linear compressor of the present invention. The back cover 560 is fastened by bolts to the rear of the stator cover 540 (shown in FIG. 3). Both side portions of the back cover 560 are bent and come into contact with the stator cover 540 (shown in FIG. 3), and these contact portions 561 are provided with bolt holes 562 for coupling to the stator cover 540 (shown in FIG. 3). Further, the back cover 560 is provided with a rear surface 563 positioned spaced a predetermined gap apart from the stator cover 540 (shown in FIG. 3) and side surfaces 564 for connecting the contact portions 561 and the rear surface 563. At the center of the rear surface 563, a hole 565 through which part of the muffler 700 (shown in FIG. 3) passes through and a main spring support portion 566 bent forward along the outer periphery of the hole 565 and fixing the rear main spring 840 (shown in FIG. 3) are formed. The inner periphery of the rear main spring 840 (shown in FIG. 3) is fitted to the outer periphery of the main spring support portion 566. Further, a support spring support portion 567 for supporting one end of the rear main spring 140 (shown in FIG. 3) is formed under the side surfaces 564. Support springs 120 and 140 (shown in FIG. 3) support a refrigerant compression assembly between the shell 110 (shown in FIG. 3) and the support spring support portion 567, so that the refrigerant compression assembly of the linear compressor is spaced apart from the bottom of the shell 110 (shown in FIG. 3). As the refrigerant compression assembly is not in direct contact with the bottom of the shell 110 because of the support springs 120 and 140 (shown in FIG. 3), noise caused by vibration transmitted to the shell 110 (shown in FIG. 3) can be reduced during the operation of the refrigerant compression assembly. Further, a muffler cover 569 preventing rearward movement of the muffler 700 (shown in FIG. 3) and having a through hole 568 through which a refrigerant inlet tube for letting in a refrigerant into the muffler 700 (shown in FIG. 3) penetrates is attached to the rear of the hole 565 of the back cover 560.

Figure 9:
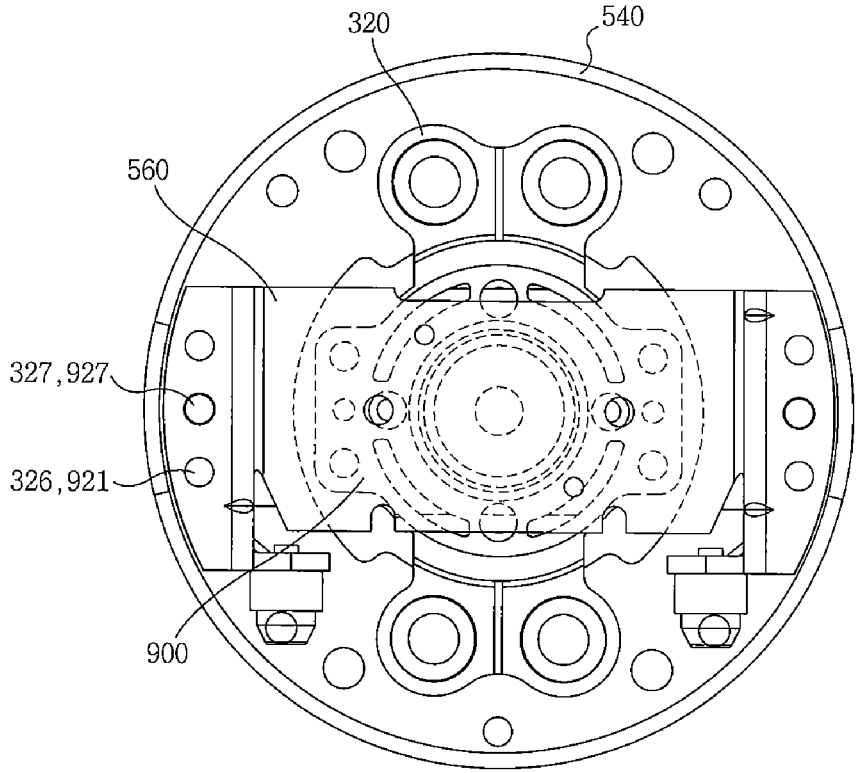
FIG. 9 is a view, as viewed from the rear, of one example in which a stator cover, the supporter piston, the spring guider and the back cover provided in the linear compressor of the present invention are coupled.

FIG. 9 is a view, as viewed from the rear, of one example in which a stator cover, the supporter piston, the spring guider and the back cover provided in the linear compressor of the present invention are coupled. As shown in FIG. 9, the guide holes 321 and 921 and the bolt holes 322 and 922 formed on the supporter piston 320 and the spring guider 900 are consistent with each other. Further, the center of the stator cover 540, the center of the body 326 of the supporter piston 320, the center of the body 910 of the spring guider 900, the center of the hole 565 of the back cover 560, and the center of the main spring support portion 567 of the back cover 560 are all consistent with each other.

Moreover, as shown in FIG. 5, the support portions 327 and 328 of the supporter piston 320 may be formed at positions symmetrical with respect to the piston 300 (shown in FIG. 3) so as to support two front main springs 820. Otherwise, as shown in FIG. 9, the support portions 327 and 328 of the supporter piston 320 may be formed at positions longitudinally symmetrical to each other so as to support four front main springs 820. By this, when the stiffness of the rear main spring 840 is changed according to a resonance operating condition, the number of the front main springs 820 can be varied according to which is more advantageous between the use of two front main springs 820 and the use of four front main springs 840.

Figure 10:
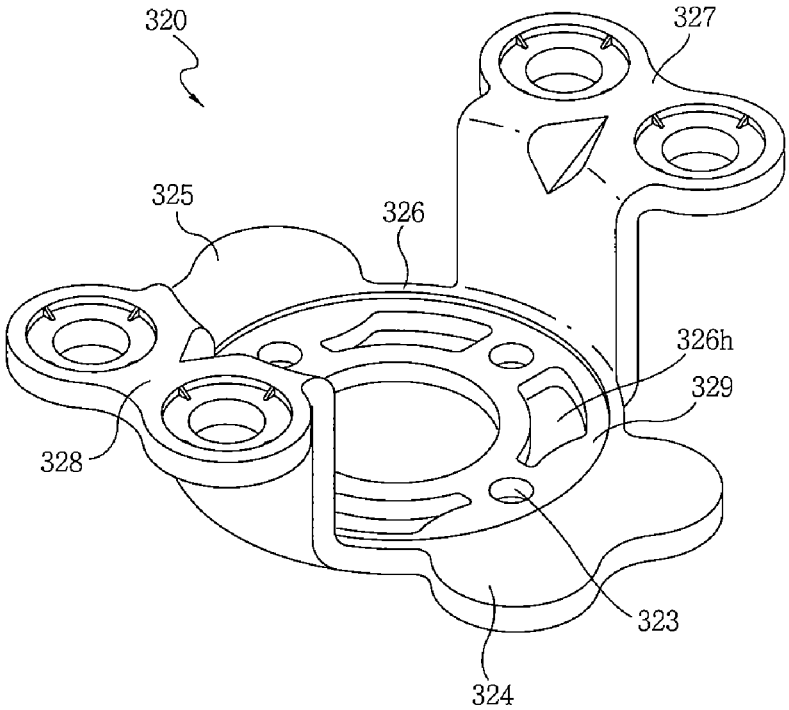
FIG. 10 is a view illustrating one example of the supporter piston provided in the linear compressor according to one embodiment of the present invention.
Figure 11:
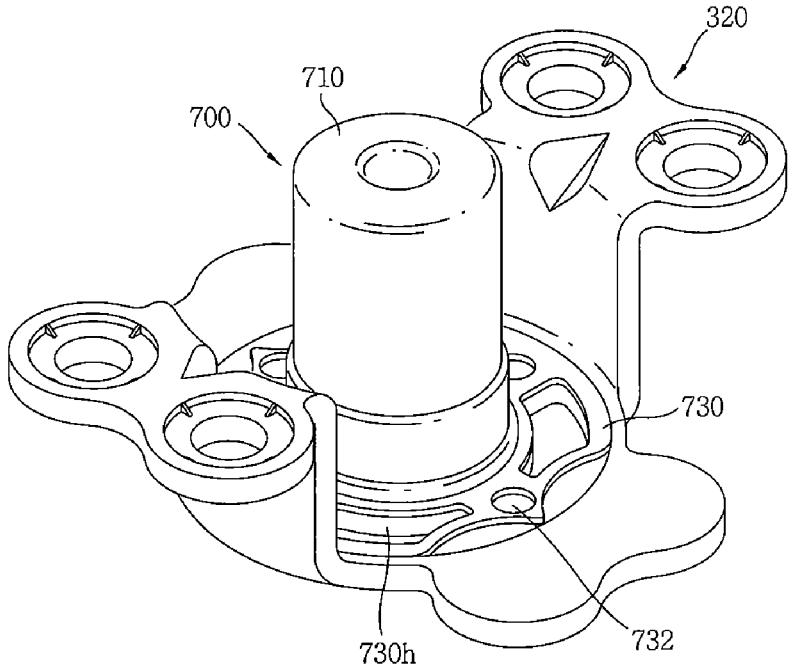
FIG. 11 is a view schematically illustrating a method for coupling the supporter piston and muffler provided in the linear compressor of the present invention.

FIG. 10 is a view illustrating one example of the supporter piston provided in the linear compressor according to one embodiment of the present invention. FIG. 11 is a view schematically illustrating a method for coupling the supporter piston and muffler provided in the linear compressor of the present invention.

The linear compressor 110 has parts for compressing a refrigerant within a shell 110, which is a hermetic vessel, the inside of the shell 110 being filled with a low pressure refrigerant. The linear compressor 100 comprises a cylinder 200 providing a space for compressing a refrigerant inside the shell 100, a piston 300 linearly reciprocating inside the cylinder to compress the refrigerant, and a linear motor 400 including a permanent magnet 460, an inner stator 420 and an outer stator 440. When the permanent magnet is linearly reciprocated by a mutual electromagnetic force between the inner stator and the outer stator, the piston 300 connected to the permanent magnet 460 is linearly reciprocated along with the permanent magnet 460. The inner stator 420 is fixed to the outer periphery of the cylinder 200. Further, the outer stator 440 is fixed to a frame 520 by a stator cover 540. The frame 520 may be formed integral with the cylinder 200, or may be manufactured separately from the cylinder 200 to be coupled to the cylinder 200. In the embodiment as shown in FIG. 3, an example of integrally forming the frame 520 and the cylinder 200 is illustrated. The frame 520 and the stator cover 540 are coupled to each other, being fastened by a fastening member, such as a bolt, thereby fixing the outer stator 440 between the frame 520 and the stator cover 540.

A supporter piston 320 is connected to the rear of the piston 300. Both ends of front main springs 820 are supported by the supporter piston 320 and the stator cover 540. Further, both ends of a rear main spring 840 are supported by the supporter piston 320 and a back cover 560, and the back cover 560 is coupled to the rear of the stator cover 540. At the rear of the piston 300, a suction muffler 700 is provided so as to reduce noise during the suction of refrigerant as the refrigerant is introduced into the piston through the suction muffler 700. The suction muffler 700 is positioned inside the rear main spring 840. Further, the inner diameter of the rear main spring 840 is fitted to the outer diameter of part of the suction muffler 700.

The inside of the piston 300 is hollowed out to introduce the refrigerant introduced through the suction muffler 700 into a compression space P formed between the cylinder 200 and the piston 300 and compress it. A valve 310 is installed at the front end of the piston 300. The valve 310 is opened to introduce the refrigerant into the compression space P from the piston 300, and closes the front end of the piston 300 so as to avoid the refrigerant from being introduced again into the piston from the compression space P.

If the refrigerant is compressed by the piston 300 in the compression space P at a pressure higher than a predetermined level, a discharge valve 620 positioned on the front end of the cylinder 200 is opened. The discharge valve 620 is installed so as to be elastically supported by a spiral discharge valve spring inside a support cap 640 fixed to one end of the cylinder 200. The compressed refrigerant of high pressure is discharged into a discharge cap 660 through a hole formed on the support cap 640, and then discharged out of the linear compressor 100 through a loop pipe R thus to circulate the refrigerating cycle.

Each of the parts of the above-described linear compressor 100 is supported in an assembled state by a front support spring 120 and a rear support spring 140, and is spaced apart from the bottom of the shell 110. Since the parts are not in direct contact with the bottom of the shell 110, vibrations generated from each of the parts are no directly transmitted to the shell 110. Therefore, noise generated from the vibration transmitted to the outside of the shell 110 and the vibration of the shell 110 can be reduced.

The supporter piston 320 is coupled to the rear of the piston, and receives a force from the main springs 820 and 840 and transmits it to the piston 300 so that the piston 300 can linearly reciprocate under a resonance condition. The supporter piston 320 is provided with a plurality of bolt holes 323 to be coupled to the piston 300.

The supporter piston 320 is installed such that its center is consistent with the center of the piston 300. Preferably, a step is formed on the rear end of the piston 300 so as to easily make the centers of the supporter piston 320 and the piston 300 coincide with each other. The supporter piston 320 has such a shape in which support portions 327 and 328 are formed at the upper and lower sides of an generally circular body 326. The support portions 327 and 328 are formed at positions symmetrical with respect to the center of the supporter piston 320. The support portions 327 and 328 are formed at the top and bottom, respectively, of the body 326, and bent twice from the body 326. That is, the support portions 327 and 328 are bent once rearward from the body 326 and then bent upward or downward, respectively. The rear end (one end) of the front main springs 820 is supported on the front of the support portions 327 and 328 of the supporter piston 320.

Regarding the main springs applying a restoration force to the supporter piston 320 to operate the piston 300 coupled to the supporter piston 320 under the resonance condition, the number of the front main springs 820 is decreased to two and the number of the rear main spring 840 is decreased to one, thereby decreasing the spring stiffness of the resonance system on the whole. Further, if the number of the front main springs 820 and the rear main spring 840 is decreased, respectively, the production cost of the main springs can be cut down.

At this time, if the stiffness of the front main springs 820 (shown in FIG. 3) and the rear main spring 840 becomes smaller, the mass of the driving unit including the piston 300, supporter piston 320 and permanent magnet 460 should be smaller to thus drive the driving unit under a resonance condition. Therefore, the supporter piston 320 is made of a non iron-based metal having a lower density than that of an iron-based metal, rather than being made of an iron-based metal. As a result, the mass of the driving unit can be reduced, and accordingly can be driven at a resonance frequency according to the decreased stiffness of the front main springs 820 and the rear main spring 840. For example, if the supporter piston 320 is made of a metal, such as aluminum, even if the piston 300 is made of a metal, the supporter piston 320 has no effect from the permanent magnet 300. Therefore, the piston 300 and the supporter piston 320 can be coupled to each other more easily.

If the supporter piston 320 is made of a non iron-based metal having a low density, this offers the advantage that the resonance condition is satisfied and the supporter piston 320 can be easily coupled to the piston 300. However, the portion contacting with the front main springs 820 may be easily abraded by a friction with the front main springs 820 during driving. When the supporter piston 320 is abraded, abraded debris may damage the parts existing on the refrigerating cycle while floating in the refrigerant and circulating the refrigerating cycle. Therefore, surface treatment is performed on the portion where the supporter piston 320 and the front main springs 820 are in contact with each other. By carrying out NIP coating or anodizing treatment, the surface hardness of the portion where the supporter piston 320 and the front main springs 820 are in contact with each other is made larger at least than the hardness of the front main springs 820. By this construction, it is possible to prevent the generation of debris by the supporter piston 320 being abraded by the front main springs 820.

Further, a suction muffler 700 is mounted at the rear of the supporter piston 320, and a refrigerant to be compressed is sucked into the piston 300 through the suction muffler 700 in a noise reduced state. The suction muffler 700 is provided with a noise chamber 710, which is a circular space for reducing noise, and a mounting portion 730 formed at one end of the noise chamber 710, i.e., an end portion contacting with the supporter piston 320 at the front side of the suction muffler 700. The mounting portion 730 is formed in an generally circular shape, extended in a radial direction from one end of the noise chamber 710.

A suction muffler guide groove 329 corresponding to the shape of the mounting portion 730 of the suction muffler 700 and accommodating the mounting portion 730 is formed at the body 326 of the supporter piston 320. The suction muffler 700 is fastened to the supporter piston 320 by bolts, with the mounting portion 730 of the suction muffler 700 being accommodated in the suction muffle guide groove 329. Therefore, it is possible to prevent bolt holes 323 of the supporter piston 320 and bolt holes 732 of the mounting portion 730 of the suction muffler 700 from longitudinally or laterally deviating from each other by a difference in size between the bolt holes 732 formed on the mounting portion 730 of the suction muffler 700 and the screw portions of the bolts and a difference in size between the bolt holes 323 of the supporter piston 320 and the bolt holes 732 of the mounting portion 730 of the suction muffler 700. As the center of the suction muffler 700 and the center of the supporter piston 320 coincide with each other without any deviation therebetween, the center of the piston 300, which coincides with the center of the supporter piston 320, also coincides with the center of the suction muffler 700.

Further, the rear main spring 840 is mounted to the outer diameter of the suction muffler 700. The inner diameter of the rear main spring 840 is fitted to the outer diameter of the suction muffler 700. Therefore, the center of the suction muffler 700 coincides with the center of the rear main spring 840. Further, the suction muffler 700 is provided with a stepped portion 720 between the noise chamber 710 and the mounting portion 730, which is stepped from the noise chamber 710 and the mounting portion 730. Preferably, the rear main spring 840 is fitted to the stepped portion 720, and supported by the stepped portion 720 and the mounting portion 730.

Moreover, holes 326*h* and 730*h* are formed at the supporter piston 320 and the mounting portion 730 of the suction muffler 700, respectively. The holes 326*h* and 730*h* allow the refrigerant filled in the shell 110 (shown in FIG. 3) to communicate with each other forward and rearward of the holes 326*h* and 730*h* when the driving unit, including the piston 300 (shown in FIG. 3), supporter piston 320, and suction muffler 700, is driven, thereby reducing the resistance during driving caused by the refrigerant. Besides, the mass of the driving unit, including the piston 300, supporter piston 320, permanent magnet 460, and suction muffler 700, can be reduced by forming the holes 326*h* and 730*h*. Accordingly, it is possible for the piston 300 to linearly reciprocate while maintaining a resonance condition with the rear main spring 840, the number of which is decreased to one, and the front main springs 820, the number and stiffness of which are decreased according to the decrease in stiffness caused by the decrease in the number of the rear main spring 840. By this construction, the production costs of the main springs can be cut down since the number of the main springs is decrease and the rigidity is decreased.

Figure 12:
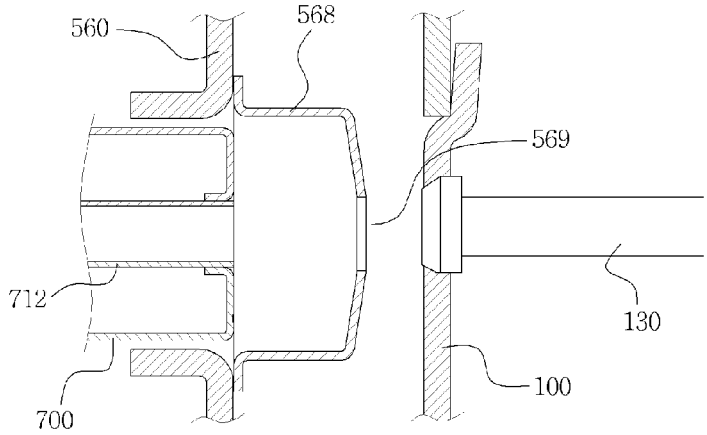
FIG. 12 is a view illustrating part of the linear compressor according to the first embodiment of the present invention.

FIG. 12 is a view illustrating one example of a back muffler 568 provided in the linear compressor of the present invention. The back muffler 568 is positioned between the suction muffler 700 and a suction pipe 130, and attached to the back cover 560. The back muffler 568 is generally circular, and has a suction hole 569 formed at the center part of one surface, which is generally circular, through which a refrigerant is introduced into the back muffler 568. Further, the other surface, which is generally circular, of the back muffler 568 is opened so that the refrigerant introduced through the suction hole 569 can be discharged to the suction muffler 700. When the refrigerant moves to the back muffler 568 from the suction pipe 130 of the linear compressor, one surface of the back muffler 568 is inclined with a gentle slope from the suction hole 569 and is projected toward the suction pipe 130. Therefore, the refrigerant introduced through the suction hole 569 is introduced into the back muffler 568 along the gentle slope, thereby reducing the loss of pressure. If one surface of the back muffler 568 is not inclined with a gentle slope with respect to the suction hole 569, the refrigerant introduced through the suction hole 569 is rapidly changed in volume due to the difference between a cross section of the suction hole 569 and a cross section of the back muffler 568, thus causing a significant damage to pressure.

Figure 13:
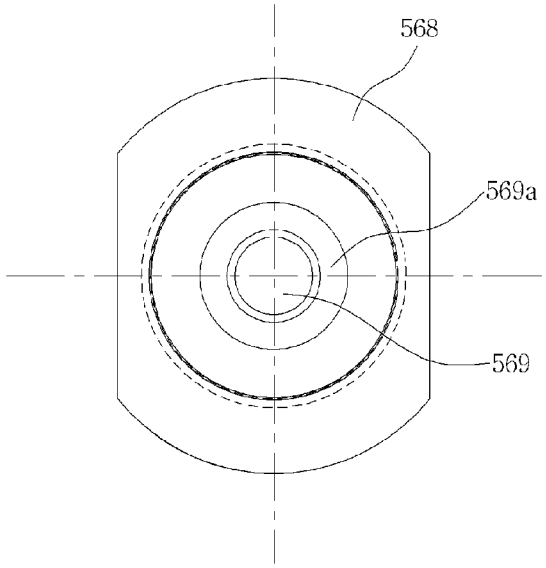
FIGS. 13 and 14 are views illustrating part of the linear compressor according to the second embodiment of the present invention.
Figure 14:
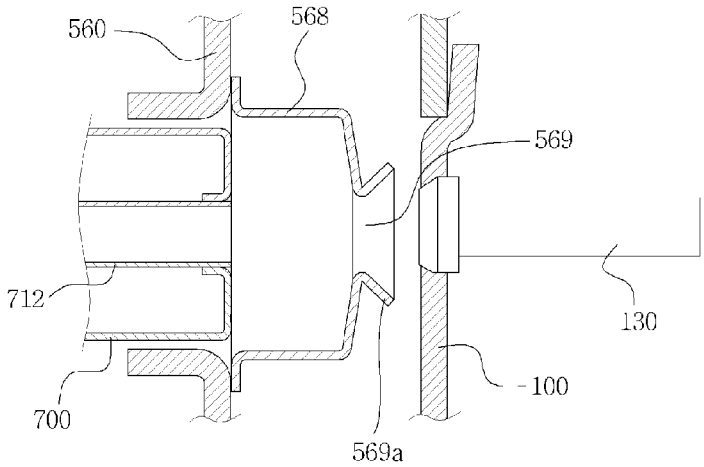
Figure 15:
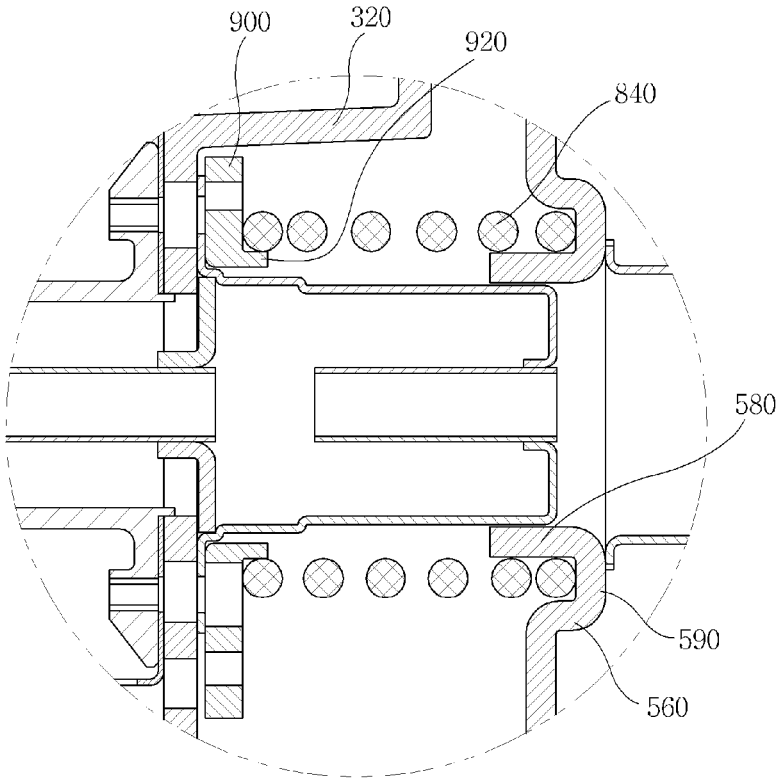
FIG. 15 is a view illustrating one example of a back cover provided in the linear compressor according to the present invention.

FIGS. 13 and 14 are views illustrating another example of the back muffler provided in the linear compressor of the present invention. The back muffler 568 is further provided with a guider 569*a* at a suction end. The guider 569*a* at the suction end of the back muffler 568 becomes wider as it gets farther from the suction hole 569. When the refrigerant is introduced into the suction hole 569 of the back muffler 568 from the suction pipe 130, the effect of proximity suction is exhibited by the guider 569*a* of the suction end, thereby decreasing the pressure loss of the refrigerant. That is, the guider 569*a* provides the same effect as making the distance between the suction pipe 130 and the suction hole 569 of the back muffler 568 smaller, and is able to suppress an increase in the amount of leakage of the refrigerant caused by a deviation between the centers of the suction pipe 130 and the suction hole 569. In other words, it is possible to reduce the sensitivity of the refrigerant leakage amount depending on the eccentricities of the suction pipe 130 and the suction hole 569.

The back muffler 568 having the guider 569*a* is formed at the suction end in order to complement a side leakage caused by the dimensions of the suction pipe 130 and back muffler 568 and the assembly and application thereof. The guider 568 at the suction end of the back muffler 568 becomes wider with respect to the suction hole 569 and is funnel-shaped. As the distance between the suction muffler 700 and the hermetic container becomes smaller as stated above, a side leakage of the refrigerant caused by the dimensions and the assembly and application decreases. Because eccentricity (e) occurs due to side leakage at the back muffler 568 and the suction pipe 130, the less the side leakage, the lower the sensitivity of eccentricity. Further, as in the first embodiment, a gentle slope is formed from the center of the suction hole 569 of the muffler 568, and hence a pressure loss upon introduction of the refrigerant can be reduced.

Consequently, a pressure loss upon introduction of the refrigerant into the suction pipe 130 can be reduced by attaching the back muffler 568 to the back cover 560 and making one surface of the back muffler 568 inclined with a gentle slope with respect to the suction hole 569, and the amount of side leakage can be decreased by providing the effect of proximity suction of refrigerant, which is the same as making the distance between the suction muffler 700 and the suction pipe 130 smaller, by means of the guider 569*a* that becomes wider with respect to the suction hole 569 of the back muffler 700. As a result, the compression efficiency of the linear compressor is improved.

Figure 16:
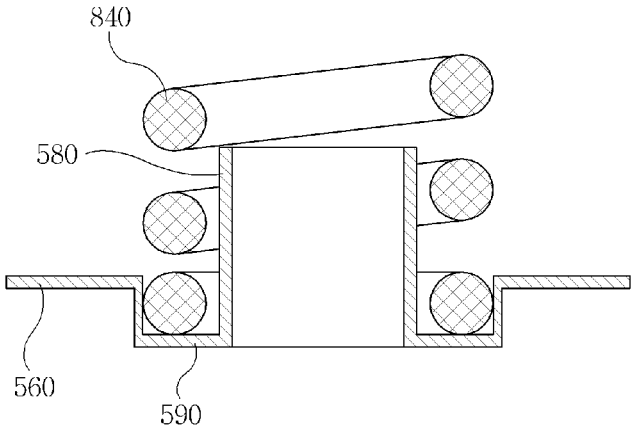
FIG. 16 is an enlarged side cross sectional view schematically illustrating one example of the rear main spring and back cover of the linear compressor according to the present invention.

FIG. 16 illustrates the supporter piston 320 and the back cover 560 that support both ends of the rear main spring 840. Here, the back cover 560 includes an outward restraining support portion for restraining the rear main spring 840 from moving outward.

Further, the spring guider 900 is positioned between the supporter piston 320 and the rear main spring 840, and guides the center of the rear main spring 840 and the center of the piston 300 to coincide with each other. Further, the spring guider 900 is provided with a stepped portion 920 to which one end of the rear main spring 840 is fitted. Moreover, of the spring guider 900, at least the portion contacting with the rear main spring 840 has a larger hardness than the hardness of the rear main spring 840.

For intuitive understanding of the outward restraining support portion restraining the rear main spring 840 from moving outward, FIG. 16 illustrates a depressed portion 590, which is depressed in the direction of a suction opening from the back cover 560. That is to say, as the depressed portion 590 is provided, the outer sides of the rear main spring 840 are supported. Further, a bent portion, which is bent toward the cylinder, is illustrated so that an inward restraining support portion for restraining the rear main spring 840 from moving inwards is formed.

Figure 17:
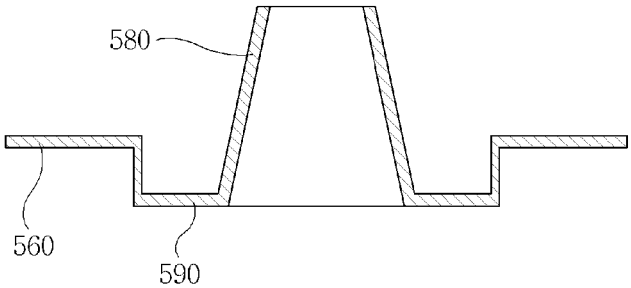
FIG. 17 is a view illustrating another example of the back cover provided in the linear compressor according to the present invention.

FIG. 17 illustrates a bent portion on the back cover 560, which is bent slopingly inwards so that an inward restraining support portion for restraining the rear main spring 840 from moving inwards is formed. As well as the outer sides of the rear main spring 840 are supported in the depressed portion 590 depressed in the direction of the suction opening, a gap may be easily formed between a skirt portion 580 of the bent portion and an inner side portion of the rear main spring 840. The gap thus formed causes a transverse displacement as the rear main spring 840 contracts and expands, thus preventing interference by the skirt portion 580 of the back cover 560. Therefore, it is possible to avoid the problems of impurity generation and noise caused by damage and abrasion of the rear main spring 840 due to interference occurring at the back cover 560 portion by which the rear main spring 840 is supported.

Of course, the inward sloping bent portion can be designed not to be hit against the suction muffler 700.

Hereinafter, various embodiments will be discussed, in which the rear main spring 840 is omitted and the rear main spring 840 can be restrained from moving transversely in the structure of the back cover 560.

Figure 18:
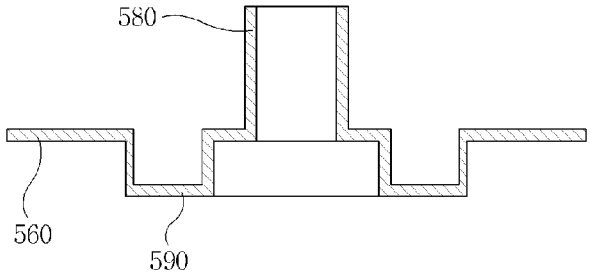
FIG. 18 is a view schematically illustrating an inward restraining support portion including a stepped bent portion which is bent in a stepped manner on the back cover of the linear compressor according to the present invention.

FIG. 18 illustrates a stepped bent portion which is bent in a stepped manner on the back cover 560 so that an inward restraining support portion for restraining the rear main spring 840 from moving inwards is formed. As well as the outer sides of the rear main spring 840 are supported in the depressed portion 590 depressed in the direction of the suction opening, a gap may be easily formed between a skirt portion 580 of the bent portion and an inner side portion of the rear main spring 840. As in FIG. 7*b*, a transverse displacement occurs as the rear main spring 840 contracts and expands, thus preventing interference by the skirt portion 580 of the back cover 560.

Of course, the stepped bent portion can be designed not to be hit against the suction muffler 700.

Figure 19:
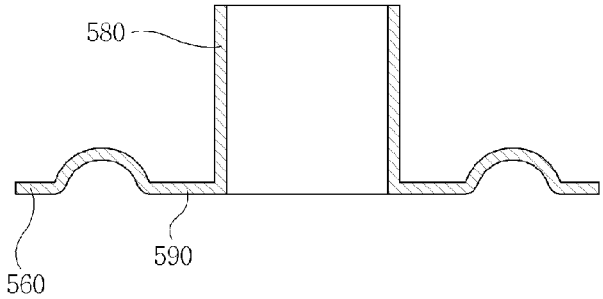
FIG. 19 is a view schematically illustrating an outward restraining support portion having a protruded portion which is protruded toward the cylinder direction from the back cover of the linear compressor according to the present invention.
Figure 20:
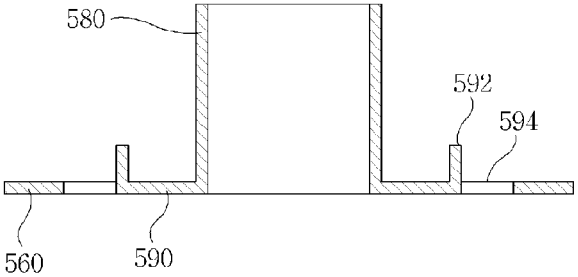
FIG. 20 is a view schematically illustrating an outward restraining support portion which is cut out at some part along the edges supporting the other end of the rear main spring on the back cover of the linear compressor of the present invention.
Figure 20:
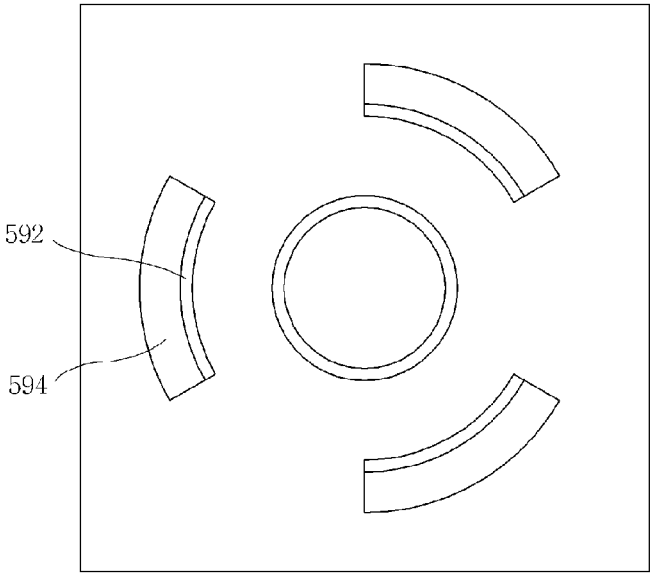

FIG. 19 is a side cross sectional view schematically illustrating an outward restraining support portion having a protruded portion which is protruded toward the cylinder direction from the back cover 560 of the linear compressor according to the present invention. FIG. 20 is a side cross sectional view schematically illustrating an outward restraining support portion which is cut out at some part along the edges supporting the other end of the rear main spring on the back cover 560 of the linear compressor of the present invention.

FIG. 19 illustrates a protruded portion which is raised in the cylinder direction on the back cover 560 so that an outward restraining support portion for restraining the rear main spring 840 from moving outwards is formed. This is an embodiment in which a protruded portion is formed on the back cover 560 in the cylinder direction so as to make it easier to provide a design for supporting the outer sides of the rear main spring 840 by having a depressed portion 590 depressed in the suction opening direction in FIGS. 16 to 19.

FIG. 20 illustrates the cutting-out of some part along the edges supporting the other end of the rear main spring so that an outward restraining support portion for restraining the rear main spring 840 from moving outwards is formed. First, the side cross sectional view of the back cover 560 illustrated in the upper side shows the outward restraining support portion 592 that is formed by lifting a cutout portion 594 which is cut from some part of the back cover 560. In the lower side, there is illustrated in a plane view the cutout portion 594 which is cut from some part of the back cover to form the outward restraining support portion 592. This is another embodiment which can substitute the design having a depressed portion formed in the cylinder direction in FIG. 19.

Figure 21:
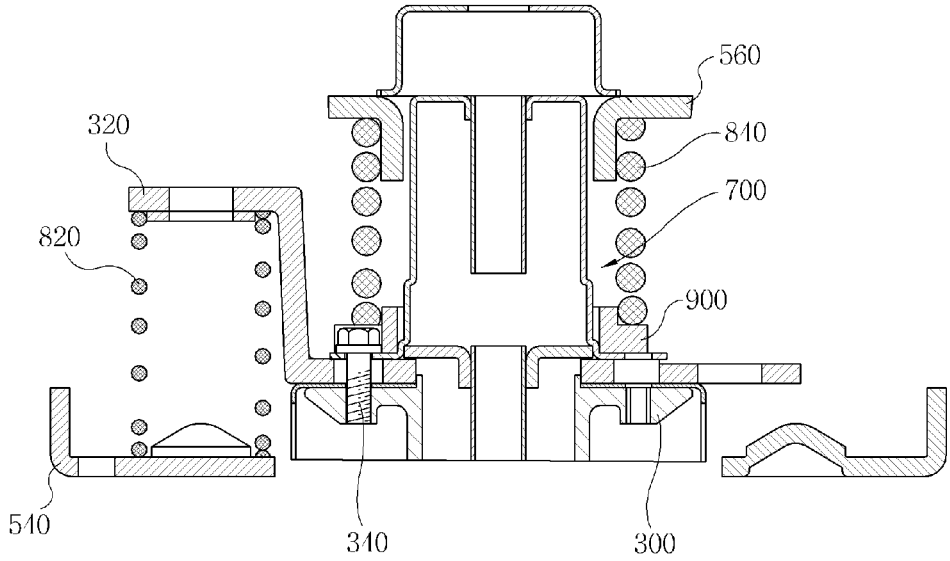
FIG. 21 is a side cross sectional view illustrating the main spring portion of the linear compressor according to the present invention.

FIG. 21 helps the structural understanding about the main spring portion of the linear compressor according to the present invention. First, both ends of the rear main spring are supported and stably mounted by the spring guider 900 and the back cover 560.

More specifically, the spring guider 900 allows a fastening bolt 340 not to be in direct contact with the rear main spring 840. The fastening bolt 340 for fastening the piston 300 and the supporter piston 320 can have an evacuation structure at the depressed portion on the outer periphery of the spring guider 900. The front main springs 820 are supported and mounted between the supporter piston 320 and the stator 540. Further, the suction muffler 700 passes through the spring guider 900 and enters inside the rear main spring 840.

Figure 22:
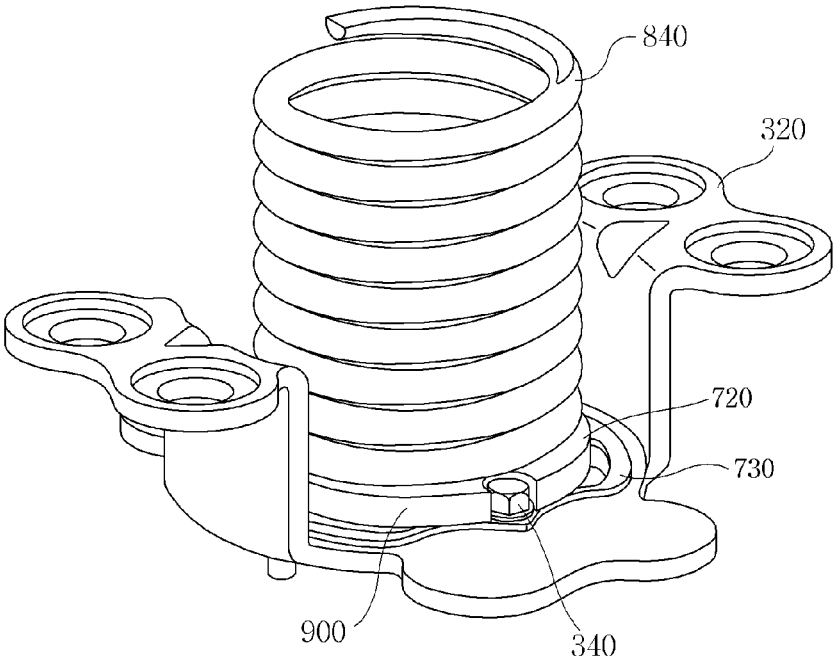
FIG. 22 is a perspective view illustrating the rear main spring portion of the linear compressor according to the present invention.
Figure 23:
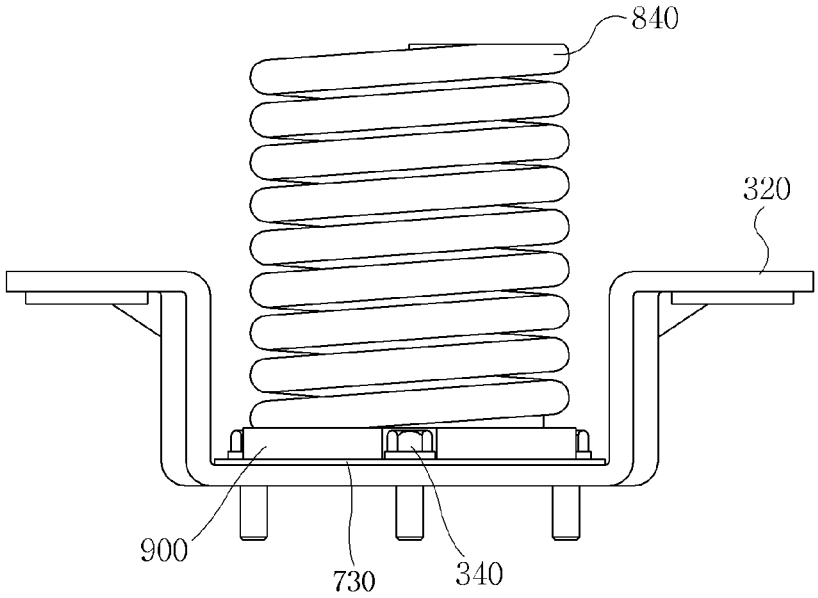
FIG. 23 is a front view of FIG. 22.
Figure 24:
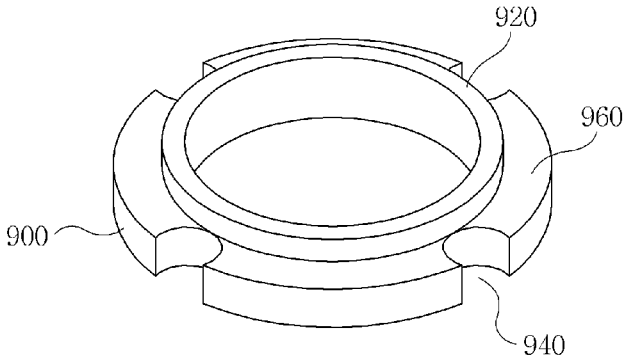
FIG. 24 is a perspective view illustrating the spring guider of the linear compressor according to the present invention.

FIG. 22 is a perspective view illustrating the rear main spring portion of the linear compressor according to the present invention. FIG. 23 is a front view of FIG. 22. FIG. 24 is a perspective view illustrating the spring guider of the linear compressor according to the present invention.

Referring to FIG. 22, the fastening bolt 340 at some part of the outer periphery of the spring guider 900 can be shown in detail. The rear main spring 840 is not in direct contact with the fastening bolt 340 because it is supportedly mounted on the spring guider 900. The fastening bolt 340 fastens an mounting portion 730 of the suction muffler and the supporter piston 320. The spring guider 900 provides an evacuation structure of the fastening bolt 340 by having a thickness larger than that of the head of the fastening bolt 340, and forms a structure in which the rear main spring 840 cannot come into contact with the fastening bolt 340.

Thus, when the suction muffler 700 is fastened over the supporter piston 320, the mounting portion 730 is fixed to the supporter piston 320 by the fastening bolt 340. And, the spring guider 900 provided with a plurality of depressed portions forming the evacuation structure of the fastening bolt 340 is placed over the mounting portion 730 of the suction muffler 720. The head of the fastening bolt 340 has a smaller height than the height of the plurality of depressed portions provided in the spring guider 900, and thus does not come into contact with the rear main spring 840.

Referring to FIG. 23, there is illustrated the rear main spring 840 being stably mounted on the spring guider 900. The spring guider 900 provides an evacuation structure of the fastening bolt 340 by making the plurality of depressed portions provided on the outer periphery have a thickness larger than that of the head of the fastening bolt 340, and prevents the rear main spring 840 from coming into direct contact with the fastening bolt 340. At the same time, the rear main spring is able to perform a stable elastic movement. Here, the fastening bolt 340 fastens the mounting portion 730 of the suction muffler and the supporter piston 320.

Referring to FIG. 24, the structure of the spring guider 900 can be understood in detail.

The stepped portion 920 of the spring guider is fitted to the rear main spring 840. A plurality of depressed portions 940 formed on the outer periphery of the spring guider have a larger height than that of the head of the fastening bolt 340. Also, the plurality of depressed portions 940 formed on the outer periphery of the spring guider form the evacuation structure of the fastening bolt, and prevents the rear main spring 840 from coming into direct contact with the fastening bolt 340.

Here, a seat portion 960 of the spring guider provides a wide area which the rear main spring 840 is seated on and in contact with. This can improve the mounting safety of the rear main spring 840 and prevent it from deflecting to one side. This can provide an accurate elastic movement.

Further, the seat portion 960 of the spring guider has a larger hardness than the hardness of the rear main spring 840 by surface treatment. This can prevent impurity generation caused by abrasion of the rear main spring 840 to be seated on the seat portion 960 of the spring guider.

Hereinafter, FIGS. 25 to 28 illustrate a structure incapable of stably mounting the rear main spring 840 by excluding the spring guider 900 according to a comparative example.

Figure 25:
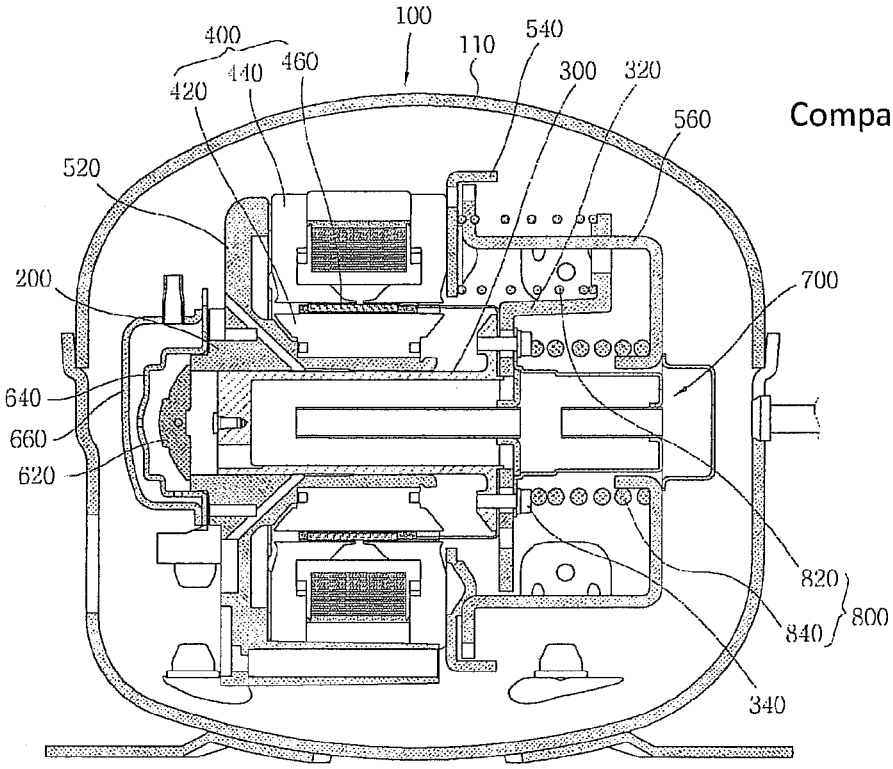
FIG. 25 is a side cross sectional view excluding the spring guider of the linear compressor according to a comparative example.
Figure 26:
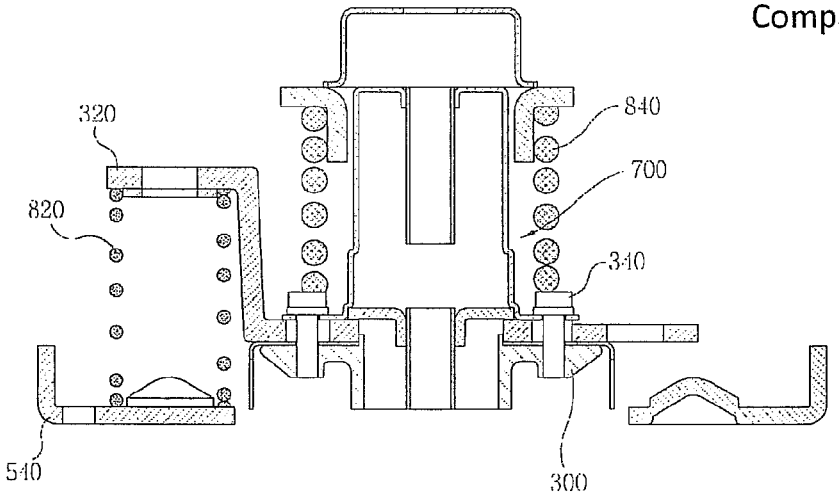
FIG. 26 is a side cross sectional view illustrating the main spring portion excluding the spring guider according to a comparative example.
Figure 27:
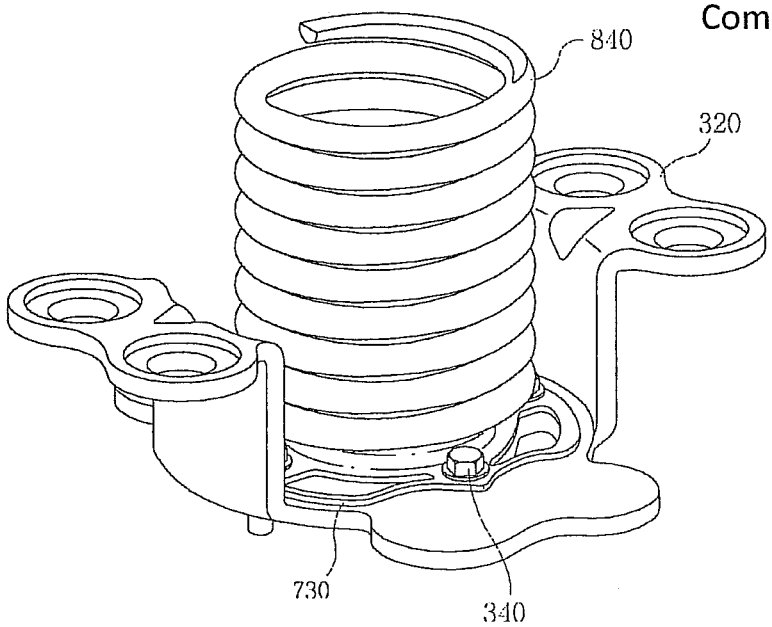
FIG. 27 is a perspective view illustrating the rear main spring portion excluding the spring guider according to a comparative example.
Figure 28:
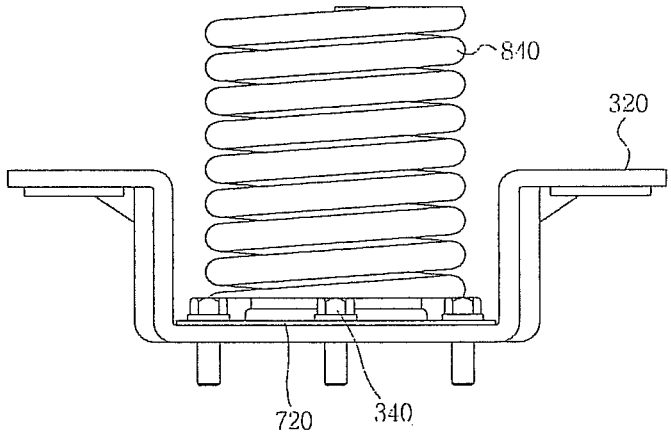
FIG. 28 is a front view of FIG. 27.

FIG. 25 is a side cross sectional view excluding the spring guider of the linear compressor according to a comparative example. FIG. 26 is a side cross sectional view illustrating the main spring portion excluding the spring guider according to a comparative example. FIG. 27 is a perspective view illustrating the rear main spring portion excluding the spring guider according to a comparative example. FIG. 28 is a front view of FIG. 27.

In FIG. 25, the rear main spring 840 is in direct contact with the fastening bolt 340 because the spring guider is excluded. This structure can provide a factor for making the elastic movement of the rear main spring 840 unstable.

FIG. 26 shows that the rear main spring 840 is placed right on the head of the fastening bolt 340 by excluding the spring guider. Here, the fastening bolt 340 fastens the piston 300 and the supporter piston 320. If the rear main spring 840 is seated right over the fastening bolt 340, an unstable elastic movement, such as deflection, may occur. The front main springs 820 are supportedly seated between the supporter piston 320 and the stator cover 540.

FIG. 27 shows an unstable structure in which the rear main spring 840 is placed on part of the head of the fastening bolt 340 by excluding the spring guider. The fastening bolt 340 fastens the mounting portion 730 of the suction muffler and the supporter piston 320. Part of a suction muffler supporting member is exposed under the rear main spring 840.

FIG. 28 shows an unstable structure in which the rear main spring 840 is placed at a part of the head of the fastening bolt 340 by excluding the spring guider. This unstable structure in which the rear main spring 840 is laid at a part of the head of the fastening bolt 340 may make an accurate elastic movement difficult. Besides, impurities may be generated by the breakage or abrasion of the rear main spring 840.

In this way, the spring guider 900 of the linear compressor according to the present invention can provide a seat portion forming a plurality of depressed portions having an evacuation structure of the fastening member so that the rear main spring 840 can stably perform an accurate elastic movement. Due to this, the performance and noise prevention of the linear compressor can be improved.

Also, the linear compressor according to the present invention can reduce parts production costs by decreasing the number of main springs.

Figure 29:
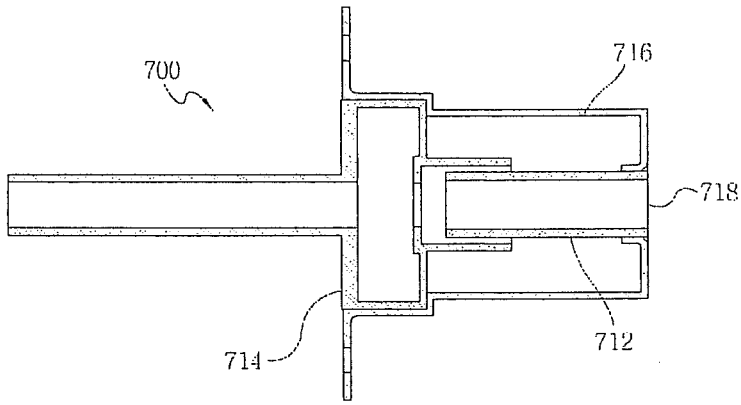
FIG. 29 is a side cross sectional view illustrating a suction muffler according to the present invention.

FIG. 29 illustrates another example of the suction muffler provided in the linear compressor according to the present invention. The suction muffler 700 includes a cylindrical support member 716 made of metal having a relatively large diameter and having an entrance/exit axially formed at the front and rear ends to allow a refrigerant to enter and exit. an internal noise tube 712 made of metal installed inside the entrance 718 of the support member, and a cylindrical external noise tube 714 made of plastic having a relatively small diameter and installed outside the exit of the support member 716.

Since the support member 716 is made of metal, it provides a predetermined strength to the other end of the piston 300 so that it can be stably supported by another fastening member. The outer noise tube 714 can be manufactured in various shapes and sizes because it is made of plastic, and a connecting portion for connecting conventional vertical and horizontal partition walls, a conventional support member, and a conventional external noise tube and the external noise tube 714 are integrally manufactured without the need for separate partition walls to be additionally assembled. This integration of the assembly parts offers the easiness of the production process by simplifying the assembly components of the suction muffler 700. Also, since the external noise tube 714 is made of plastic, production costs can be cut down by reducing material costs and processing costs and production efficiency can be improved by shortening the assembly time. Besides, the freedom degree of design can be improved.

Here, the support member 716 and internal noise tube 72 being made of metal are preferable in consideration of the noise characteristics. Flow noise of the refrigerant causes an effective transmission loss in metal, rather than plastic. The support member 716 and the internal noise tube 712 can effectively reduce flow noise of the refrigerant since they are made of metal. On the other hand, the external noise tube 714 has a structure surrounded by the inside of the piston 300 and the support member 716 and internal noise tube 712 made of metal. Therefore, even if the external noise tube 714 is made of plastic, a radiated noise thereof can be ignored.

Especially, the internal noise tube 712 may be assembled so as to be supported on assembly projections (not shown) formed at the inside of the support member 716 and the inside of the external noise tube 714, while the external noise tube 714 may be configured to have an elastic contact portion (not shown) formed at one end so that the elastic contact portion of the external noise tube 714 can be press-fitted to the exit of the support member 716 by using the elastic force of the material itself.

Figure 30:
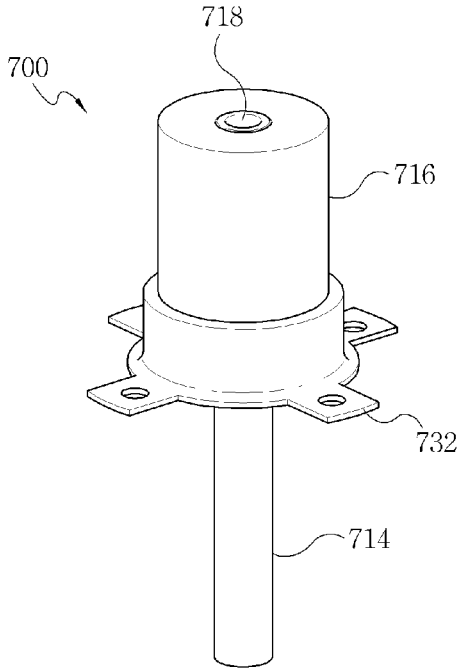
FIG. 30 is a perspective view illustrating a suction muffler according to the present invention.

FIG. 30 is a perspective view illustrating a suction muffler according to the present invention. The support member 716 provided with the inlet 718 and the external noise tube 714 can be intuitively recognized externally. Although the conventional support member is provided with a bolt fastening portion in a flange shape to be fastened to the piston and the supporter piston, the support member 716 is designed to have a shape which is simplified by eliminating the other regions except a bolt fastening portion 732 thus reducing the production process and production costs. The bolt fastening member 732 takes the form of a cross which is symmetrical and separated from each other.

Subsequently, in the linear compressor thus constructed, the piston 300 linearly reciprocates inside the cylinder 200 as the linear motor 400 is operated. As a result, a pressure in the compression space P is varied, and hence flow noise of the refrigerant is reduced by a pressure difference as the refrigerant passes through the suction muffler 700 via the inlet tube. Even if flow noise is generated along with the flow of the refrigerant, the refrigerant rapidly expands/contracts as it passes through the internal noise tube 712 and the external noise tube 714, or a flow loss is generated by a large flow resistance to thus reduce noise. The refrigerant passed through the suction hole(not shown) of the piston is introduced into the compression space P and compressed, and then discharged to the outside.

Figure 31:
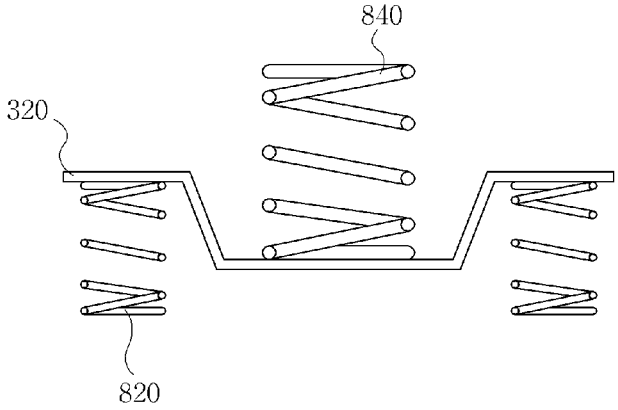
FIG. 31 is a side cross sectional view illustrating the main spring portion of the linear compressor according to the present invention.

FIG. 31 is a view illustrating a structure in which the front main springs 820 and rear main spring 840 of the linear compressor according to the present invention are supported by the supporter piston 320. The structure of the main springs of the present invention is more useful than the structure using four front main springs and four rear main springs in terms of cost reduction and the manufacture and management depending on quantity. Also, even when compared with the structure using one front main spring and one rear main spring, the inner diameter of the cylinder can be changed by structurally mounting the front main springs outside the cylinder, thereby enabling the development of various models.

Figure 32:
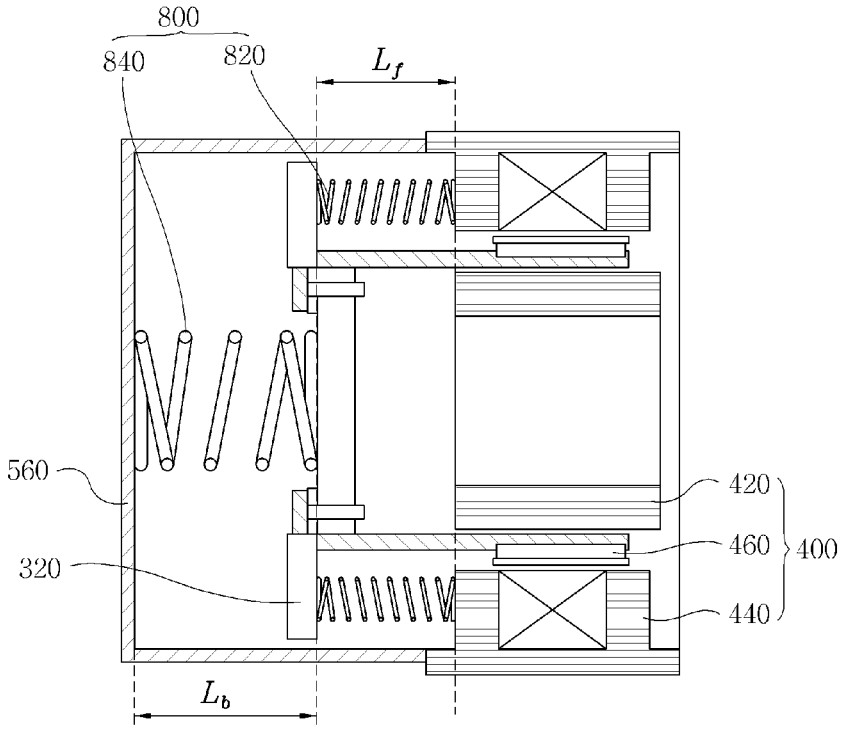
FIG. 32 is a view showing the stiffness relation of the main springs according to the present invention.

In FIG. 32, the stiffness and mounting distance conditions of the front main springs 820 and rear main spring 840 of the present invention can be checked. The piston 300 (shown in FIG. 3) linearly reciprocates by the linear motor. Also, two front main spring 820 and one rear main spring 840 are installed, respectively, at the front and rear of the supporter piston 320 connected to the piston 300. The front main springs 820 and the rear main spring 840 are contracted or pulled with linear reciprocation of the piston 300. As a result, a restoration force caused by the stiffness of the front main springs 820 and rear main spring 840 is transmitted to the piston 300. It is preferable to determine the stiffness of the front main springs 820 and rear main spring 840 enough to allow the driving unit including the piston 300 to move in a resonance condition. This is because when the front main springs 820 and the rear main spring 840 have rigidity enough to allow the piston 300 to move in a resonance condition, power supplied to the linear motor driving the piston 300 can be most minimized.

The sum of the stiffness coefficients Kf of the front main springs 820 are generally the same as the stiffness coefficient Kb of the one rear main spring 840 installed at the rear side. This is applied to a case where the stiffness coefficients Kf of the front main springs 820 are slightly changed by a tolerance that may be generated upon manufacture and installation, as well as a case where the stiffness coefficients Kf of the front main springs 820 are completely consistent with each other.

Further, the mounting distances of the front main springs 820 and rear main spring 840 are generally equal. Here, the mounting distances of the front main springs 820 and rear main spring 840 refer to the length of the front main springs 820 and the length of the rear main spring 840 when the front main springs 820 and the rear main spring 840 are in an equilibrium state in a state that the operating member is not in operation. The mounting distance Lf of the front main springs 820 and the mounting distance Lb of the rear main spring 840 are generally equal to each other, which is also applied to a case where the mounting distances Lf and Lb are slightly changed by a tolerance upon manufacture and installation. Since the mounting distance Lf of the front main springs 820 and the mounting distance Lb of the rear main spring 840 are equal, a stroke distance of the piston 300 (shown in FIG. 3) can be set as long as possible, and it is easy to set a stroke distance.

As a result, the stiffness coefficient Kf of the front main springs is generally ½ times the stiffness coefficient Kb of the rear main springs, or the stiffness coefficient Kb of the rear main spring is generally two times the stiffness coefficient Kf of the front main springs.

In this way, the linear compressor according to the present invention is useful in terms of the cost reduction of main springs and the manufacture and management depending on quantity by having two front main springs and one rear main spring, and enables it to change the inner diameter of the cylinder without changing the structure of the entire main springs because the front main springs are structurally mounted at an outer side portion.

Figure 33:
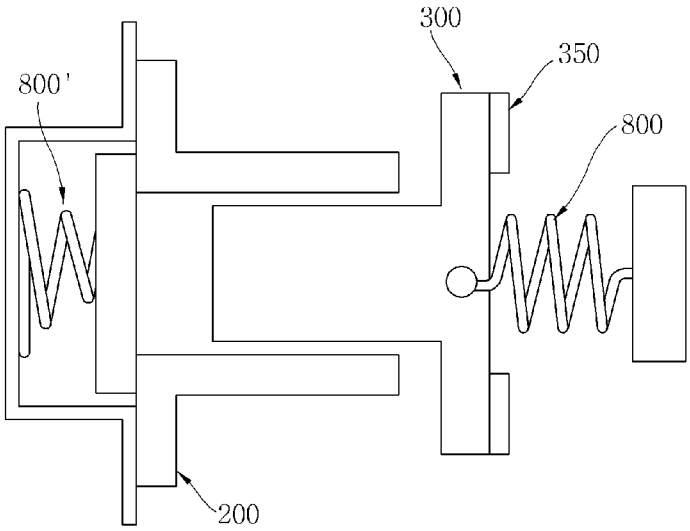
FIG. 33 is a mathematical modeling of the linear compressor.

FIG. 33 is an illustration of the mathematical modeling of the linear compressor. The piston 300 is inside the cylinder 200. The term "supporter piston" has the same meaning as "piston". To the piston 300 and the supporter piston, a main spring 800 is connected. If the piston 300 is compressed to more than a certain level, an elastic force caused by hydraulic pressure is generated. A gas spring 800' is a modeling of this phenomenon.

In case of a linear compressor used for a cooling device or the like, if the type of cooling device is different, a required cooling capacity is different, and this leads to the need to adjust a flow rate. The flow rate of the compressor is expressed by the following equation 1.

$$Q=D\times(A\times S\times f) \quad \text{[Equation 1]}$$

wherein D denotes a proportional constant, A denotes a cross sectional area of the piston, S denotes a reciprocating distance of the piston, and f denotes an operation frequency of the piston stroke.

Conventionally, in order to change a reference flow rate, a reciprocating distance (stroke) S is changed by changing the full length of the piston 300. In the present invention, there is prepared a linear compressor, which satisfies a reference flow rate in a manner that the reference flow rate is adjusted by changing a reciprocating frequency of the piston 300 in order to change a reference flow rate.

Such a linear compressor is advantageous in terms of the production and management of a linear compressor because the linear compressor of the piston does not need to additionally have a means for adjusting the full length in order to adjust the stroke S and the full length and the initial values are not changed even if the reference flow rate is changed. By the way, in a case where the operation frequency of the piston is changed according to a reference flow rate, the frequency of mechanical resonance and the frequency of resonance of the piston should be consistent with each other to provide high efficiency due to resonance. Thus, it is preferable to change the mechanical resonance frequency of the compressor as well. The mechanical resonance frequency f is expressed by Equation 2.

$$f_m = \frac{1}{2\pi}\sqrt{\frac{k_m + k_g}{m}} \quad \text{[Equation 2]}$$

wherein $k_m$, $k_g$, and m denotes the physical coefficient of elasticity of a spring 10*a* connected to the piston 300, the spring constant of a gas spring 10*b*, and the mass of the piston 300, respectively.

When D, A, and S are determined in Equation 1, the operation frequency f is determined according to the reference flow rate Q. Concretely, a method of determination is as follows. When A and S are fixed at around a specific frequency, the reference flow rate Q linearly increases or decreases as the operation frequency f increases or decreases. Hence, a desired operation frequency f is calculated by obtaining a difference between a reference flow rate at a specific frequency and a required reference flow rate and then calculating a difference between a specific frequency and a required operation frequency based on the above difference.

A cooling device, such as a refrigerator, is in a low-power condition requiring only a small cooling capacity only to keep a cooling state more often, rather than in an overload condition requiring a lot of cooling capacity. Therefore, an additional mass member 350 is attached to the piston 300 or the guide portions 324 and 325 (shown in FIG. 5) of the supporter piston 320 (shown in FIG. 3) so that a resonance may occur at a mechanical resonance frequency of the linear compressor corresponding to an operation frequency in the low-power condition. The mechanical resonance frequency $f_m$ of the entire linear compressor can be changed by adjusting the mass of the additional mass member 350.

The additional mass member 350 should have a mass satisfying the following Equation 3.

$$f = f_m = \frac{1}{2\pi} \cdot \sqrt{\frac{k_m + k_g}{m}} \quad \text{[Equation 3]}$$

wherein $m_d$ is the mass of the additional mass member 350, $f_m$ is a mechanical resonance frequency, and f is an operation frequency set according to a reference flow rate. The mechanical resonance frequency $f_m$ is a value at which the spring constant $k_g$ of the gas spring 800' varies according to the position of the piston, and accordingly varies with time. Consequently, it is necessary to track or estimate the mechanical resonance frequency $f_m$ at which the operation frequency varies, especially, in a low-power condition. This will be explained later.

The linear compressor thus constructed is formed to be operated at the required operation frequency $f_c$ identical to the mechanical resonance frequency $f_m$ of the piston calculated by the mechanical spring constant $K_m$ of the coil spring and the gas spring constant $K_g$ of the gas spring under the load considered in the linear motor at the time of design, for example, under a low-power condition. Therefore, the linear motor is operated in the resonance state merely under the low-power condition, to improve efficiency.

Figure 34:
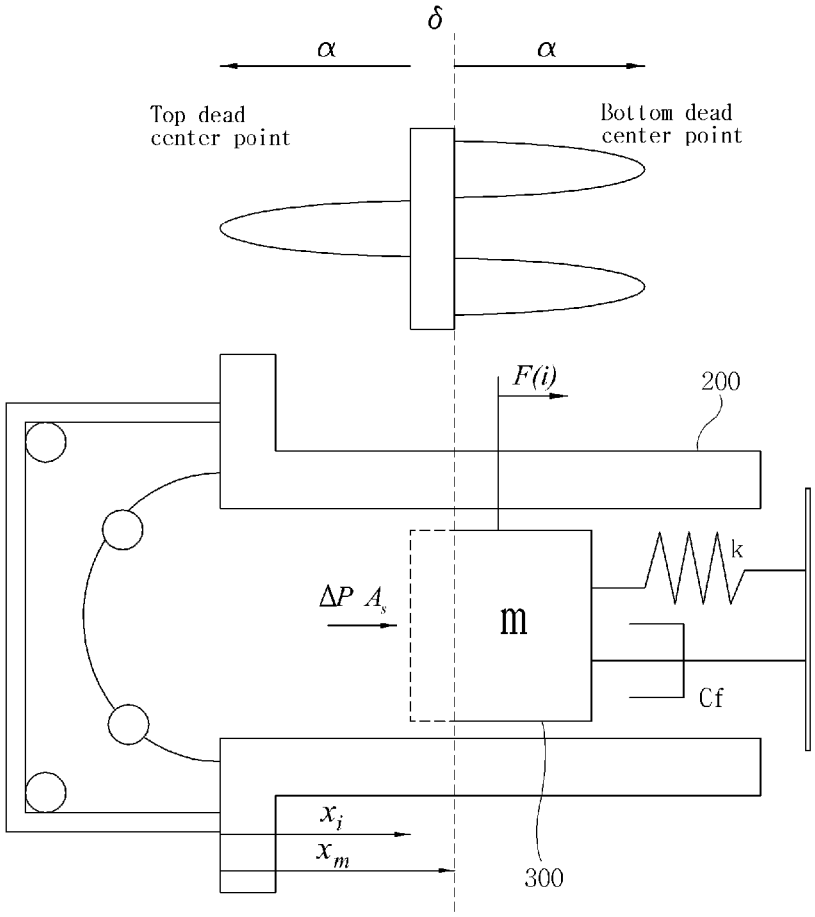
FIG. 34 is a view illustrating the operation and mathematical modeling of the piston of a reciprocating compressor according to the present invention.

FIG. 34 is a view illustrating the operation and mathematical modeling of the piston of a reciprocating compressor according to the present invention. Herein, $\alpha$ denotes a distance moved in one direction when no external force is applied, and $\delta$ denotes a distance shifted by the force of a refrigerant being compressed. The upper side of FIG. 34 briefly shows the movement of the piston. When power is applied to the linear motor 400 (shown in FIG. 3) before an external force is applied, the piston 300 (shown in FIG. 3) moves, and the stroke of the piston 300 (shown in FIG. 3) becomes $\alpha+\delta+\alpha=2\alpha+\delta$. Conventionally, when a voltage is asymmetrically applied, the stroke becomes $\alpha_2+\delta+\alpha_2\times\beta=\alpha_2(1+\beta)+\delta_2$. That is to say if $\delta$ has a value of $\alpha_2(1+\beta)+\delta_2$, $2\alpha+\delta=\alpha 2(1+\beta)+\delta_2$ is obtained, thus apparently providing the same effect as adjusting the stroke by asymmetrically applying a voltage in the conventional art.

The movement of the piston 300 (shown in FIG. 3) is mathematically described. If a displacement from the cylinder 200 (shown in FIG. 3) to the head of the piston 300 (shown in FIG. 3) is denoted by x, the following equation is achieved.

$$m\ddot{x}+c_x\dot{x}+k(x-x_i)=F(i)+\Delta P\cdot A_s \quad \text{[Equation 4]}$$

wherein $X_i$ is an initial value of the piston, F(i) is an external force, $\Delta P\cdot A_S$ is a force applied by the refrigerant. If x(t) is assumed to be $X_m$+u(t) and substituted into Equation 1a, the following equation is established.

$$m\ddot{u}+c_f\dot{u}+k(u+x_m-x_i)=F(i)+\Delta P\cdot A_S \quad \text{[Equation 5]}$$

Here, $c_x$ in Equation 4 and $c_f$ in Equation 5 are equal to each other.

Here, if Equation 5 is divided into an AC component and a DC component, the following Equation is established.

$$m\ddot{u}+c_f\dot{u}+ku=F(i)$$

$$k(x_m-x_i)=\Delta P\cdot A_s \quad \text{[Equation 2]}$$

wherein $\Delta P$ is the difference between a discharge pressure and a suction pressure in the cooling cycle of the cooling device. The larger the cooling capacity, the larger $\Delta P$. Accordingly, $x_m-x_i$ is automatically adjusted according to a required cooling capacity. Here, $x_m-x_i$ is the same as $\delta$. Accordingly, the larger the required cooling capacity, the larger the stroke.

Here, $\delta$ will be defined as $$\delta(=x_m-x_i)=\frac{\Delta P\cdot A_s}{k}=G(k, A_s, \Delta P).$$

If $\delta$ has a value of $\alpha_2(1+\beta)-2\alpha+\delta_2$, the same effect as adjusting the stroke by asymmetrically applying a voltage in the conventional art can be provided as explained above. Accordingly, instead of asymmetrical operation in the conventional art, if $\delta$ is increased by decreasing the elastic coefficient $k_m$ of the spring, the stroke can be increased even under an overload condition even if a symmetrical voltage is applied.

Under the overload condition, the cooling capacity $Q_e$ is expressed as follows.

$$Q_e=\dot{m}\cdot\Delta h=\rho\cdot A_s\cdot\dot{x}\cdot\Delta h=\eta\cdot S\cdot f \quad \text{[Equation 7]}$$

wherein $\eta$ is a proportional constant, S is a stroke, and f is an operation frequency.

There is a need that the larger the required cooling capacity, the larger the length of the stroke. Thus, under the entire cooling capacity condition, the stroke only has to be larger than the maximum value with which the piston can reciprocate. That is, it is preferable that the stroke required to provide a required flow rate with respect to the maximum flow rate of the reciprocating compressor is smaller than the sum of two times the initial value and the distance that the piston is shifted due to the above flow rate. To satisfy this condition, the following equation should be met.

$$S=\frac{Q_{max}}{\eta\cdot f}\leq(2\cdot\alpha+G(k_m, A_s, \Delta P)) \quad \text{[Equation 8]}$$

Hereinafter, Equation 8 will be referred to as a maximum cooling capacity condition. Here, as described above, $G(k_m, A_s, \Delta P)=A_s\times\Delta P/k_m$ is satisfied, $\eta$ is a proportional constant, S is a stroke, and f is an operation frequency. $Q_{max}$ denotes a maximum cooling capacity. Satisfying Equation 8 means that the stroke S of the piston is changed by a change of a required cooling capacity in the reciprocating compressor, and a required flow rate is provided due to the changed stroke. That is to say, there is a need to select an elastic coefficient $k_m$ and an initial value $\alpha$ satisfying Equation 8. When the elastic coefficient $k_m$ and the initial value $\alpha$ a are thusly selected, the mechanical resonance frequency is determined, and the operation frequency is selected identically to the mechanical resonance frequency satisfying $$f = f_m = \frac{1}{2\pi} \cdot \sqrt{\frac{k_m + k_g}{m}}$$

because a resonance has to occur in order to improve efficiency. Here, kg denotes an elastic coefficient when it is assumed that a force applied by gas is a force applied by the spring, which will be described in detail later. Further, the operation frequency f should satisfy $$f = \frac{1}{2\pi}\sqrt{\frac{k_m + k_g}{m}} = \frac{Q_e}{\eta \cdot S}$$

because Qe=n·S·f should be satisfied.

Figure 35:
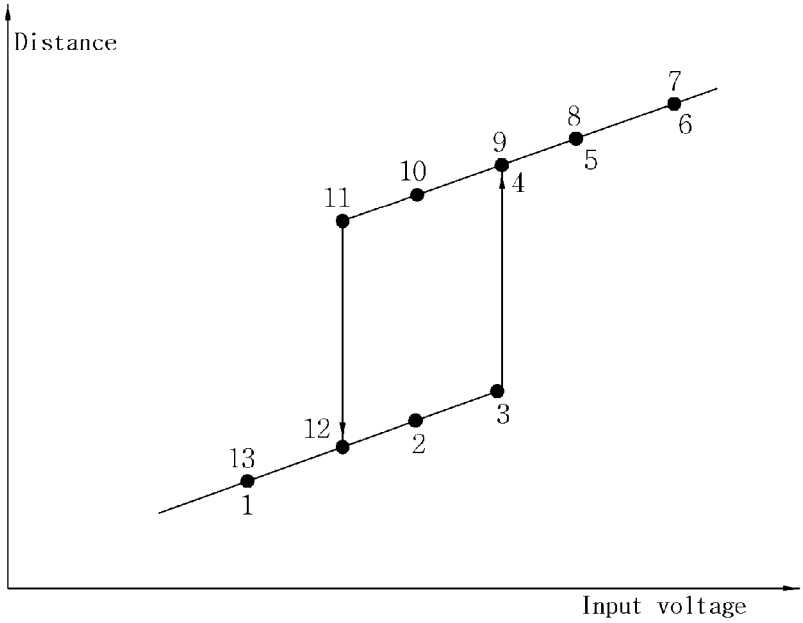
FIG. 35 is a view for explaining a displacement of the piston in accordance with a change in input voltage.

FIG. 35 is a view for explaining a displacement of the piston in accordance with a change in input voltage.

A distance notated on the Y axis refers to a distance between the position of the piston and one surface constituting the compression space. During the linear reciprocating motion of the piston, the point at which the piston is the closest to one surface constituting the compression space of the cylinder is referred to as a top dead center position (or top dead center portion), and the point at which the piston is the farthest to one surface constituting the compression space of the cylinder is referred to as a bottom dead center position (or bottom dead center portion).

In FIG. 35, a distance on the y-axis refers to a distance between the position of the piston and one surface constituting the compression space. At first, in the reciprocating compressor, the piston 300 (shown in FIG. 3) is positioned at the top dead center (position 1), and as the voltage is changed, the piston becomes distant from one surface constituting the compression space of the cylinder 200 (shown in FIG. 3) (positions 1 to 3). When the position of the piston becomes distant enough from one surface constituting the compression space and hence the pressure becomes less than a predetermined value (position 3), a discharge valve assembly adapted to be opened and closed in accordance with an inside pressure of the compression space is closed. Due to this, the piston 300 (shown in FIG. 3) becomes rapidly distant from one surface constituting the compression space (position 4), and, in this state, the position of the piston changes with voltage (positions 4 to 11). When the position of the piston becomes close enough to one surface constituting the compression space and hence the pressure becomes more than a predetermined value (position 11), the discharge valve assembly adapted to be opened and closed in accordance with an inside pressure of the compression space is opened. Due to this, the piston 300 (shown in FIG. 3) becomes rapidly close to one surface constituting the compression space, and in this state, the position of the piston changes with voltage (positions 12 and 13).

When the refrigerant acts as the gas spring by its elastic force as above, the force applied by the refrigerant gas becomes nonlinear due to the opening and closing of the discharge valve assembly. As a result, the distance between the piston (shown in FIG. 3) and one surface constituting the compression space is rapidly changed in some region. Such a phenomenon is called a jump phenomenon. and this may cause a disturbance in obtaining the gas spring constant $k_g$. A method for obtaining the gas spring constant $k_g$ will be described below.

Figure 36:
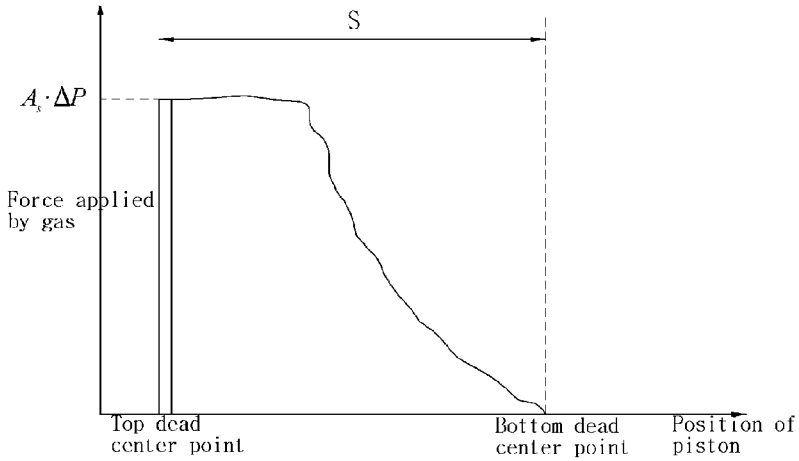
FIG. 36 is a view showing the force applied by gas in accordance with the position of the piston.

FIG. 36 is a view showing the force applied by gas in accordance with the position of the piston. As the force applied by gas is varied in accordance with the position of the piston, the above-described spring generally produces a force in proportion to a displacement from the initial position (F=−kx). However, in a case where a force is applied by a refrigerant (gas), the applied force increases as it gets farther from the bottom dead center portion (or top dead center point), which is the reference point, but does not increase to more than a predetermined value ($\Delta P \cdot A_s$). Here, $F_c(t)$ indicates a force produced by gas.

Therefore, when this nonlinear force $k_g$ applied by gas is assumed to be a force applied by the spring, in order to obtain the elastic coefficient of the spring, there is a need to employ a describing function method.

The describing function method is a method for equalization in order to analyze nonlinear control. When a specific waveform (for example, sine wave) is applied as an input signal, a specific waveform whose basic oscillation cycle is the cycle of a specific input waveform is outputted. By the way, the amplitude and phase thereof are different from the previous ones. Of this output, such a fundamental wave having the same cycle can be represented as a describing function by a difference in amplitude and phase.

When the force $F_c(t)$ applied by the gas is assumed to be the force applied by the gas spring by means of a describing function, the elastic coefficient thereof is obtained by the following equation:

$$k_g = \frac{4 \cdot f}{S} \int_0^{\frac{1}{f}} F_c(t) \cdot \sin(2\pi \cdot f \cdot t) dt.$$

By substituting this elastaic coefficient into the condition of an operation frequency, the following equation:

[Equation 9]

$$f = \frac{1}{2\pi}\sqrt{\frac{k_m + \frac{4f}{S}\int_0^{\frac{1}{f}} F_c(t) \cdot \sin(2\pi \cdot f \cdot t) dt}{m}} = \frac{Q_e}{\eta \cdot S}$$

is established.

Herein, $k_m$ is an elastic coefficient, η is a proportional constant, S is a stroke, and $$\frac{4 \cdot f}{S} \int_0^{\frac{1}{f}} F_c(t) \cdot \sin(2\pi \cdot f \cdot t) dt$$

is a gas spring constant. By the way, as the gas spring constant is a value that changes with time, the mechanical resonance frequency also changes with time. Since the efficiency is good in the resonance state, the control unit controls power applied to the linear motor 400 (shown in FIG. 3) so that the operation frequency f can follow or track the mechanical resonance frequency.

Figure 37:
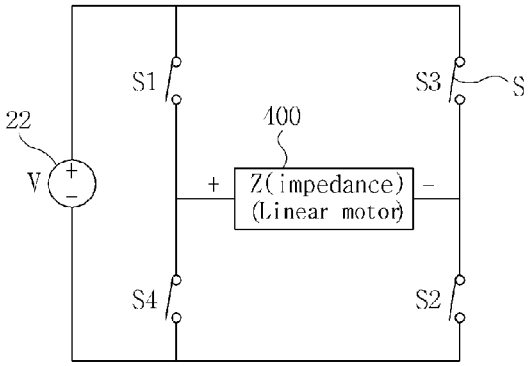
FIG. 37 is an example of a circuit diagram for operating the linear compressor at a mechanical resonance frequency.

FIG. 37 is an example of a circuit diagram for operating the linear compressor at a mechanical resonance frequency. If the operation frequency is changed in order to obtain a required flow rate, the frequency of a voltage applied to the linear motor 400 (shown in FIG. 3) is changed. By the way, the mechanical resonance frequency is also changed with time as the gas spring constant $k_g$ is changed in accordance with the position of the piston 300 (shown in FIG. 3). In response to the mechanical resonance frequency changing with time, the power applied to the linear motor 400 (shown in FIG. 3) needs to be controlled.

The control unit (not shown) controls the power applied to the linear motor 400, and preferably includes inverter units S1 to S4.

ably includes inverter units S1 to S4. Specifically, controlling in a full bridge manner in the inverter circuit will be described. The inverter units S1 to S4 controls a DC power source 22 having a voltage of V to supply power to the linear motor 400 (shown in FIG. 3). The inverter units S1 to S4 receive a power or voltage from the DC power source 22, and applies an AC voltage having a desired frequency and amplitude to a coil section according to a command value (drive).

The linear compressor thus constructed is preferable because efficiency can be improved by operating the linear motor 400 (shown in FIG. 3) at an operation frequency $f_c$ consistent with the mechanical resonance frequency $f_m$ of the piston calculated by the mechanical spring constant $K_m$ of the coil spring and the gas spring constant $K_g$ of the gas spring under the load considered at the time of design. By the way, the in above-stated linear compressor, as the actual load is varied, the gas spring constant $K_g$ of the gas spring and the mechanical resonance frequency $f_m$ of the piston calculated in consideration thereof are varied. Therefore, it is preferable that the frequency or operation frequency $f_c$ applied to the coil section are varied in accordance with a varied mechanical resonance frequency $f_m$.

The power applied to the coil section 21 by the control unit can be applied by following or tracking the mechanical resonance frequency $f_m$. A method in which the power applied to the coil section 21 follows or tracks the mechanical resonance frequency $f_m$ will be described below.

The reciprocating compressor of the present invention has two degrees of freedom because both the cylinder 200 (shown in FIG. 3) and the piston 300 (shown in FIG. 3) are not fixed, but connected to a shell 100 (shown in FIG. 3) by an elastic member, such as a spring. Concretely, in the linear compressor, the position x and electric charge Q of the piston or a current I, which is a differential value of the electric charge, may become variables. A system having two degrees of freedom sometimes may have two resonance frequencies, and as power is applied, starting from a low operation frequency to a high frequency, the following phenomenon occurs as follows.

At a frequency lower than the frequency having a smaller value (first resonance frequency) among the resonance frequencies, the phases of the two variables (the position x of the piston and the current I) have no specific correlation with each other. On the other hand, if the frequency becomes close to the frequency having a smaller value (first resonance frequency), the difference between the phases of (the position x of the piston and the current I) decreases. Therefore, the closer to a resonance frequency the frequency becomes, the smaller the difference between the position x of the piston and the current I. If the operation frequency becomes larger than the first resonance frequency, the difference between the position x of the piston and the current I becomes larger again. That is, the frequency at which the difference between the phases of the two variables (the position x of the piston and the current I) is the smallest is rendered to be an operation frequency. When the frequency is larger or smaller than the first resonance frequency, the increase and decrease of the difference between the position x of the piston and the current I is inversed. This phenomenon is referred to as a phase inversion.

Figure 1:
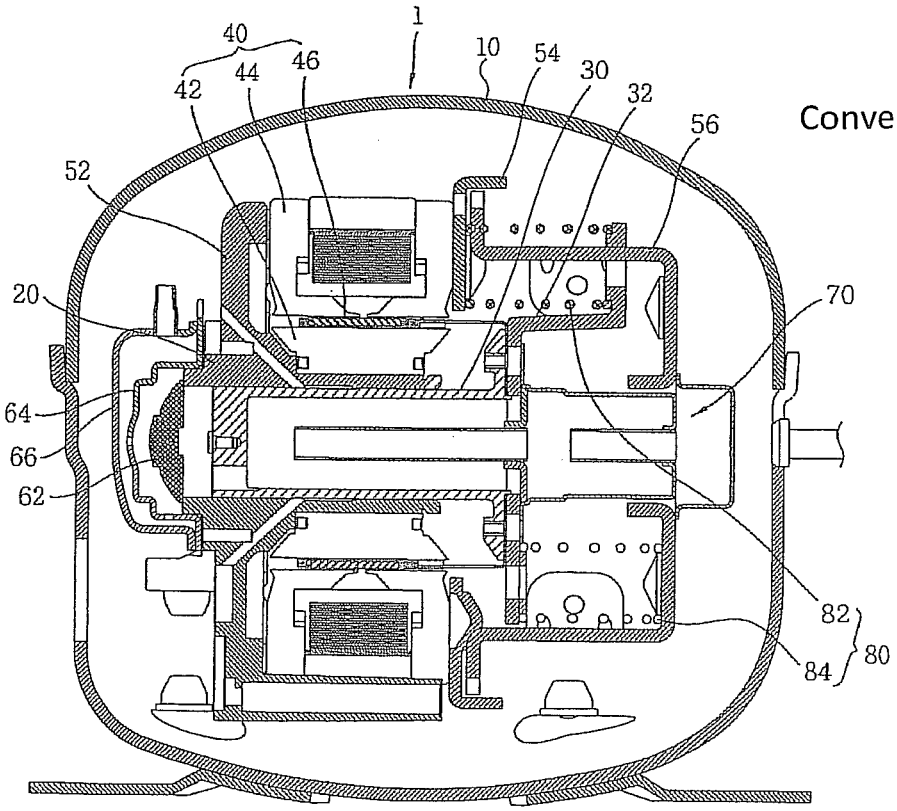
FIG. 1 is a view illustrating one example of a conventional linear compressor.

The point at which the piston is the closest to one surface constituting the compression space P of the cylinder 200 (shown in FIG. 3) is referred to as a top dead center position (or top dead center portion), and the point at which the piston is the farthest to one surface constituting the compression space P of the cylinder 200 (shown in FIG. 3) is referred to as a bottom dead center position (or bottom dead center portion). The above-described phase inversion is observed most clearly when the head of the piston 300 (shown in FIG. 3) in the reciprocating compressor comes into contact with one surface of the cylinder 200 (shown in FIG. 3) constituting the compression space (P of FIG. 1), that is, when the top dead center is positioned at one surface of the cylinder.

Therefore, if controlling is done so that the difference in phase between the two variables (the position x of the piston and the current I) is the smallest, this means tracking the mechanical resonance frequency $f_m$, and if controlling is done so that the phase inversion occurring in the vicinity of the mechanical resonance frequency $f_m$ may be most clearly observed, this means that the top dead center of the piston (6 of FIG. 1) is controlled to be positioned at the cylinder.

Figure 38:
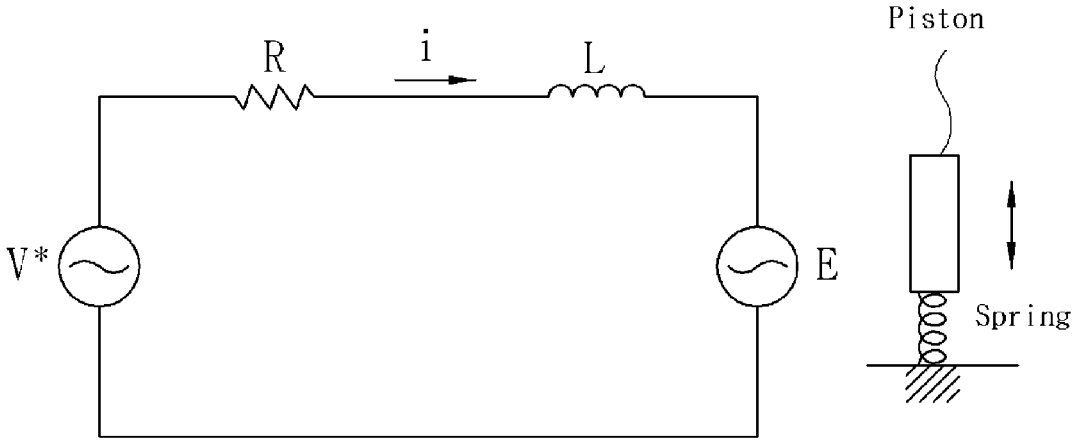
FIG. 38 is an equivalent circuit diagram in case where the linear motor makes a model as an R-L circuit having a counter electromotive force.

FIG. 38 is an equivalent circuit diagram in case where the linear motor makes a model as an R-L circuit having a counter electromotive force. In this equivalent circuit diagram, a theoretical basis for representing the movement of the piston 300 can be expressed by the following differential equation:

$$E = V^* - Ri - L\frac{di}{dt}.$$

Here, R represents an equivalent resistance, L represents an equivalent inductance coefficient, i represents a current flowing through the motor, and V* represents a voltage command value corresponding to an output voltage from the inverter units. The aforementioned variables are all measurable, so that a counter electromotive force E can be calculated.

In addition, theoretical basis of the motion of the piston 6 is explained by a mechanical motion equation such as the following equation:

$$m\frac{d^2x}{dt^2} + C\frac{dx}{dt} + kx = ai.$$

Here, and x represents a displacement of the piston 300, m represents a mass of the piston 300, C represents a damping coefficient, k represents an equivalent spring constant, and α represents a counter electromotive force constant. The mechanical equation obtained by transforming the above equation into a complex number type is defined as the following equation:

$$E = \frac{a^2}{C + \left(m\omega - \frac{k}{\omega}\right)j}i.$$

Here, ω represents a number of oscillations.

A mechanical resonance occurs at a frequency at which the difference in phase between the two variables (position x of the piston and current I) is the smallest. The counter electromotive force E and the position x of the piston are in a strong correlation or in a proportional relation. When the phase difference between the two variables (position x of the piston and current I) is the smallest, the value thereof may be zero by adjusting the reference of the phases of the counter electromotive force E and current I. By this procedure, in theory, it can be considered that, when the complex number part of the denominator in the equation:

$$E = \frac{a^2}{C + \left(m\omega - \frac{k}{\omega}\right)j} i$$

is zero, the resonance frequency is reached.

However, as described above, as the equivalent spring constant k is varied with load, the operation frequency $f_c$ is controlled to track a changing mechanical resonance frequency $f_m$ by detecting the phase of the counter electromotive force and the phase of the current and varying and synchronizing the operation frequency $f_c$ in accordance with them.

In the above-described controlling method, the resonance state is achieved by using the variables (R, L, i, V*) measurable in the electrical model, rather than estimating the mechanical resonance frequency $f_m$ by accurately calculating the spring constant K which is a mechanical variable, thus rendering the linear compressor not to be sensitive to mechanical accuracy when actually manufacturing it. Therefore, additionally, the above-described controlling method enables it to easily overcome mechanical errors occurring in the manufacturing process and perform a compression and suction process in a resonance operation when manufacturing the linear compressor.

The inverter units that may be provided in the control unit generate a sine wave voltage according to a voltage command value V*. First, a voltage command value V* and a current i are detected, and accordingly a counter electromotive force E. Afterwards, a phase of the current i is detected and then a phase difference between the current i and the counter electromotive force E is calculated by comparing the phases of the counter electromotive force E and the current i. A frequency change value Δf for making the phase of the current i equal to the phase of the counter electromotive force E is obtained by the calculated phase difference, and the voltage command value V* is corrected by generating such a frequency change value Δf. The control unit generates a sine wave voltage again in accordance with the changed voltage command value V*. By this procedure, the operation frequency $f_c$ can track a changing mechanical resonance frequency $f_m$.

Figure 39:
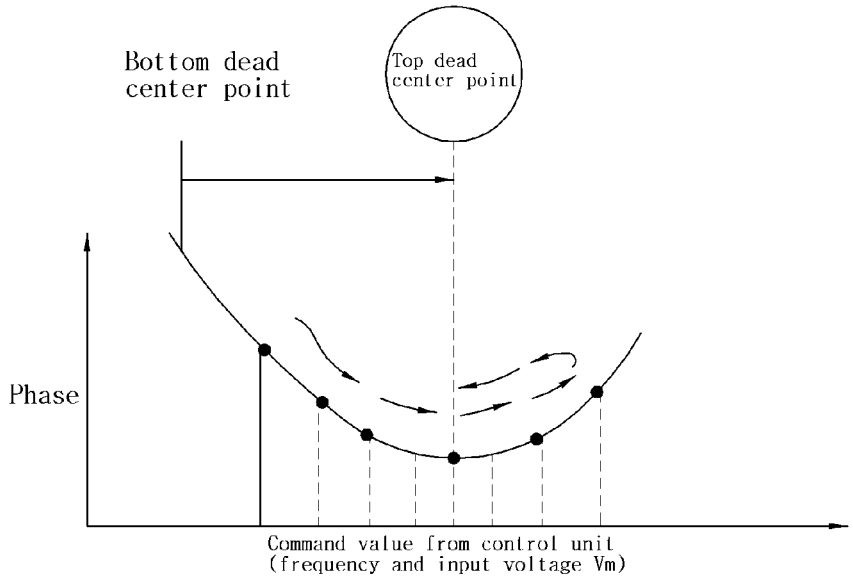
FIG. 39 is a view for explaining a method in which the control unit controls power so as to follow or track a mechanical resonance frequency.

FIG. 39 is a view for explaining a method in which the control unit controls power so as to follow or track a mechanical resonance frequency. The X axis indicates the frequency and amplitude of voltage Vm applied to the linear motor 400 (shown in FIG. 3), which are controlled by the control unit, and the Y axis actually indicates the above-described phase difference between the counter electromotive force E and the current i. It has been described that a y value on the X axis is changed with frequency, and the y value is the smallest when the frequency has the same value as a resonance frequency.

The control unit obtains a frequency change value Δf for making the phase of the current i and the phase of the counter electromotive force E equal to each other in order to make the y value the smallest, and the control unit can control the y value so as to be the smallest by generating such a frequency change value Δf and correcting the voltage command value V* (indicated by arrow). Further, controlling can be done such that a phase inversion may be observed clearly. In conclusion, this means that controlling is done such that the operation frequency $f_c$ may follow or track the mechanical resonance frequency $f_m$ and the top dead center point of the piston 300 (shown in FIG. 3) may be at one surface of the cylinder 200 (shown in FIG. 3).

Figure 40:
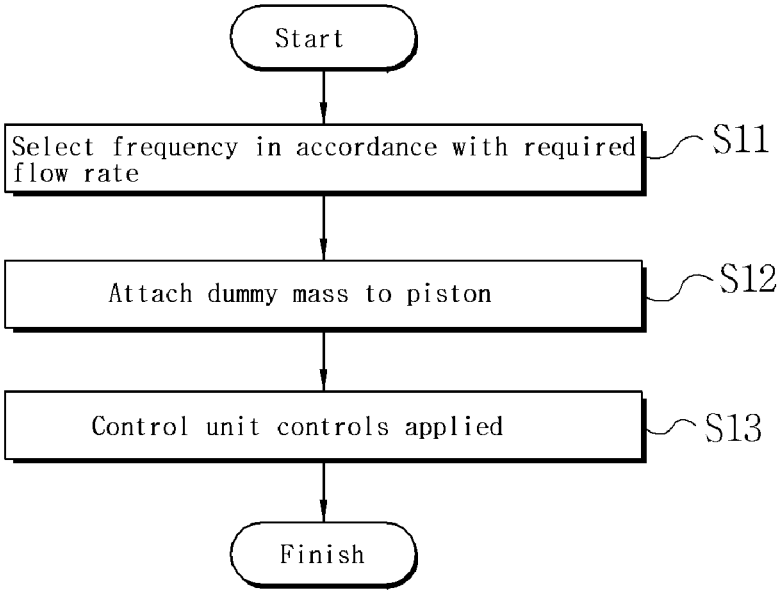
FIG. 40 is a sequential chart for explaining a method for adjusting the flow rate of the linear compressor according to the present invention.

FIG. 40 is a sequential chart for explaining a method for (adjusting) controlling the flow rate of the linear compressor according to the present invention. The linear compressor needs to adjust a flow rate in accordance with a cooling capacity required by a cooling device, and the linear compressor performs the following process so as to provide a required flow rate.

In a step S11 of setting a frequency in accordance with a required flow rate, when A and S are fixed at around a specific frequency, an appropriate operation frequency is set by a linear increase or decrease of the reference flow rate Q caused when the frequency f linearly increases or decreases in the vicinity of the specific frequency. In a step S12 of attaching an additional mass member 350 to the piston, $an_d$ satisfying $$f_m = \frac{1}{2\pi}\sqrt{\frac{k_m + k_g}{m + m_d}}$$

at a fixed mechanical frequency $f_m$ is obtained. Here, km, kg, m, and $an_d$ denote a physical elastic coefficient of the spring 800' connected to the piston 300, an elastic coefficient of the gas spring 800', a mass of the piston 300, and a mass of the additional mass member 350 to be attached, respectively.

In a step S13 of controlling an applied power by the control unit, power is controlled such that the operation frequency $f_c$ may follow a set mechanical resonance frequency $f_m$ in a low-power condition and the top dead center point of the piston 300 may come into contact with one surface constituting the compression space of the cylinder. In more detail, when the control unit can control such that the resonance frequency may be followed by using the phenomenon that the increase and decrease in phase between the piston 300 (shown in FIG. 3) and a current are inversed at the left and right of the resonance frequency, and the top dead center point may become closer to the cylinder 200 (shown in FIG. 3) by using the phenomenon that a phase is inversed when the head of the piston 200 (shown in FIG. 3) gets closer to one surface constituting the compression space P of the cylinder 200 (shown in FIG. 3).

Figure 41:
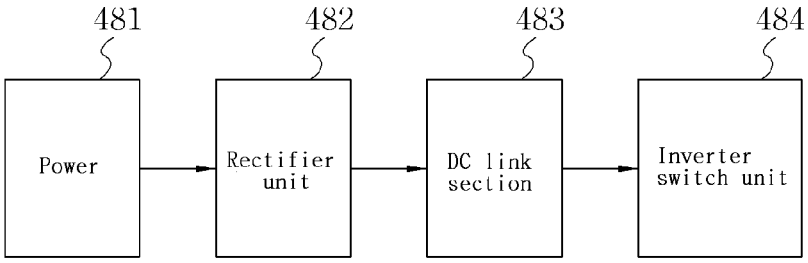
FIG. 41 is a view for conceptually explaining a power supply apparatus of the reciprocating compressor according to the present invention.

FIG. 41 is a view for conceptually explaining a power supply apparatus of the reciprocating compressor according to the present invention.

The power supply apparatus comprises a rectifier unit for rectifying AC power supplied from an AC power supply unit, a DC link section for stabilizing the rectified power, and an inverter switch unit 484 for controlling the power supplied to a coil section. An AC power is typically supplied from outside through an AC power supply unit 481, such as a cable. The rectifier unit 482 functions to rectify an AC power to make the AC power flow only in one direction, and the DC link section 483 functions to reduce a variation of the amplitude of the rectified power (functions to stabilize). As the purpose of the rectifier unit 482 and the DC link section 483 is to convert an AC power into a stable DC power, the two components can be combined into a power conversion unit. The inverter switch unit 484 controls power applied to the inverter through switches. The controlled power passes through the inverter switch unit 484, and is turned into an AC power having an appropriate amplitude and frequency, and the AC power is applied to the linear motor 400 (shown in FIG. 3).

The invention claimed is:

1. A linear compressor, comprising:

a hermetic container configured to be filled with a refrigerant;

a linear motor including an inner stator, an outer stator, and a permanent magnet;

a piston that is linearly reciprocated by the linear motor;

a cylinder that provides a space to compress the refrigerant upon linear reciprocation of the piston;

a supporter piston having a connecting portion connected to one end of the piston that contacts the piston at a front surface of the connecting portion, a support portion that extends from the connecting portion so as to be bent and extend rearward from the connecting portion and then further bent to extend in a first direction symmetrically with respect to a center of the supporter piston and a guide portion that extends from the connecting portion in a second direction, which is perpendicular to the first direction;

a plurality of front main springs mounted at positions symmetrical with respect to a center of the piston, wherein a rear end of each front main spring is supported by a front surface of the support portion of the supporter piston;

a single rear main spring, a front end of the rear main spring is supported by a rear surface of the connecting portion of the supporter piston; and at least one additional mass member selectively mounted to the guide portion of the supporter piston.

2. The linear compressor of claim 1, wherein the piston includes an extended portion to which the supporter piston is fastened, and wherein the supporter piston further includes a fastening hole formed at the connecting portion, to fasten to the extended portion.

3. The linear compressor of claim 2, wherein the supporter piston further includes a windage loss reduction hole formed at the connecting portion at a position not overlapping with the fastening hole.

4. The linear compressor of claim 1, further comprising a spring guider coupled to the connecting portion of the supporter piston, to reinforce a strength of the connecting portion to support the rear main spring.

5. The linear compressor of claim 4, wherein a center of the spring guider is aligned with a center of the piston and a center of the supporter piston, and wherein the center of the spring guider is fixed to the supporter piston.

6. The linear compressor of claim 4, wherein the spring guider has a stepped portion that restrains the front end of the rear main spring from moving in a radial direction of the spring guider.

7. The linear compressor of claim 4, wherein the supporter piston and the spring guider have guide holes at positions corresponding to each other, respectively, that guide a coupling position.

8. The linear compressor of claim 4, wherein the spring guider at a portion contacting the rear main spring has a higher hardness than a hardness of the rear main spring.

9. The linear compressor of claim 4, wherein the linear compressor further comprises a suction muffler configured to introduce the refrigerant into the piston while reducing noise, and wherein a part of the suction muffler is inserted into the piston by passing through a refrigerant inlet hole of the supporter piston.

10. The linear compressor of claim 9, wherein the suction muffler includes a main body having a generally circular shape, one end of the main body extending in a radial direction so as to be connected to the supporter piston and the other end of the main body having a refrigerant inlet hole configured to introduce the refrigerant, an internal noise tube positioned inside the main body, and an external noise tube positioned inside the piston.

11. The linear compressor of claim 10, wherein the supporter piston includes a seat portion that guides the main body of the suction muffler so as to be aligned with respect to the supporter piston.

12. The linear compressor of claim 10, wherein the suction muffler is made of an injection-moldable material.

13. The linear compressor of claim 10, wherein the internal noise tube and the external noise tube are integrally formed.

14. The linear compressor of claim 9, wherein the suction muffler is fastened to the supporter piston by a fastening member, and wherein the spring guider is provided with a fastening member receiving hole that receives the fastening member to fasten the supporter piston and the suction muffler.

15. The linear compressor of claim 1, further comprising a back cover that supports the rear end of the rear main spring.

16. The linear compressor of claim 1, wherein the back cover includes at least either a bent portion or a projected portion that fixes the rear end of the rear main spring.

17. The linear compressor of claim 15, further comprising a back muffler positioned between the back cover and the hermetic container.

18. The linear compressor of claim 17, wherein the back muffler is welded to the back cover.

19. The linear compressor of claim 17, wherein the back muffler is formed in a generally circular shape, with the back cover side face being opened and a center part of the hermetic container side face projecting toward the hermetic container, and wherein the back muffler includes a refrigerant inlet hole generally at the center part.

20. The linear compressor of claim 1, wherein the front main springs and the rear main spring have a natural frequency generally coinciding with a resonant operation frequency of a driving member including the piston and supporter piston.

21. The linear compressor of claim 1, further comprising a stator cover that supports one end of the outer stator and each front end of the front main springs.

22. The linear compressor of claim 21, wherein the stator cover has a front main spring support portion having a number and position corresponding to a number and position of the front main springs.

23. The linear compressor of claim 1, wherein the front main springs and the rear main spring have generally a same stiffness.

24. The linear compressor of claim 1, wherein the front main springs and the rear main spring have generally a same length in a state in which the linear compressor is not driven.

25. The linear compressor of claim 1, wherein the at least one additional mass member comprises a plurality of additional mass members attachable to and detachable from the guide portion of the supporter piston.

26. The linear compressor of claim 1, wherein a mass of the at least one additional mass member is a mass with which the piston can be operated in a resonance condition in consideration of a stroke of the piston determined depending on a refrigerant compression capacity of the linear compressor.

27. The linear compressor of claim 1, further comprising a controller that controls an operation frequency of the supporter piston in accordance with whether the at least one additional mass member is mounted or not and a mass thereof.

28. The linear compressor of claim 27, wherein the controller controls the operation frequency by tracking a mechanical resonance frequency depending on the mass of the at least one additional mass member in a lower power condition.

29. The linear compressor of claim 27, wherein the controller controls the operation frequency so that a phase difference between a position of the piston and a current is a smallest value.

30. The linear compressor of claim 1, wherein a shifting amount of the piston determined by a spring constant of the plurality of front main springs and the rear main spring allows the piston to symmetrically move between a top dead center and a bottom dead center in a maximum load operation condition of the linear compressor.

31. The linear compressor of claim 30, wherein an initial position of the piston with respect to the cylinder is determined so that the piston symmetrically moves between a top dead center and a bottom dead center in the maximum load operation condition.

32. The linear compressor of claim 30, further comprising a controller that controls the piston to reciprocate in a resonance condition.

33. The linear compressor of claim 32, wherein the controller adjusts an operation frequency of the piston according to a required cooling capacity.

34. The linear compressor of claim 32, wherein the controller controls a motion of the piston so that a difference between a current phase and position of the piston is the smallest.

35. The linear compressor of claim 32, wherein the controller calculates a position of a top dead center of the piston according to a required cooling capacity of the linear compressor by using an inflection point of phase and stroke.

36. A linear compressor, comprising:

a hermetic container configured to be filled with a refrigerant;

a linear motor including an inner stator, an outer stator, and a permanent magnet;

a piston that is linearly reciprocated by the linear motor;

a cylinder that provides a space to compress the refrigerant upon linear reciprocation of the piston;

a supporter piston having a connecting portion connected to one end of the piston that contacts the piston at a front surface of the connecting portion, a support portion that extends from the connecting portion, and a guide portion that extends from the connecting portion;

a plurality of front main springs mounted at positions symmetrical with respect to a center of the piston, wherein a rear end of each front main spring is supported by a front surface of the support portion of the supporter piston;

a single rear main spring, a front end of the rear main spring is supported by a rear surface of the connecting portion of the supporter piston; and a controller that controls the piston of the linear compressor to reciprocate in a resonance condition, wherein a shifting amount of the piston is determined by a spring constant of the plurality of front main springs and the single rear main spring, allows the piston to symmetrically move between a top dead center and a bottom dead center in a maximum load operation condition of the linear compressor, wherein the controller calculates a position of the top dead center of the piston according to a required cooling capacity of the linear compressor by using an inflection point of phase and stroke of the linear motor, and wherein the controller includes a PWM type full-bridge inverter control logic that controls the calculated top dead center position of the piston such that an actual top dead center position of the piston and the calculated top dead center position of the piston coincide with each other.

37. The linear compressor of claim 32, wherein the controller includes a rectifier circuit and two inverter switches.

38. The linear compressor of claim 36, wherein the rectifier circuit includes a back pressure rectification circuit.

39. The linear compressor of claim 1, further comprising a power supply apparatus including a rectifier that rectifies AC power to direct current and an inverter switch that controls application of a rectified voltage to the linear motor, to supply power to the linear motor.

* * * * *